US010716411B2

(12) United States Patent
Plested et al.

(10) Patent No.: US 10,716,411 B2
(45) Date of Patent: Jul. 21, 2020

(54) ADAPTABLE CHILD CARRIER SYSTEM

(71) Applicant: Diono, LLC, Sumner, WA (US)

(72) Inventors: Nigel Plested, Manchester (GB); Paul Richardson, Manchester (GB); Szymon Klos, Manchester (GB)

(73) Assignee: Diono, LLC, Sumner, WA (US)

( * ) Notice: Subject to any disclaimer, the term of this patent is extended or adjusted under 35 U.S.C. 154(b) by 0 days.

(21) Appl. No.: 16/129,381

(22) Filed: Sep. 12, 2018

(65) Prior Publication Data

US 2019/0075939 A1 Mar. 14, 2019

Related U.S. Application Data

(60) Provisional application No. 62/557,926, filed on Sep. 13, 2017.

(51) Int. Cl.

| | |
|---|---|
| ***A47D 13/02*** | (2006.01) |
| ***A45F 3/14*** | (2006.01) |
| *A45F 3/04* | (2006.01) |

(52) U.S. Cl.

CPC ..... *A47D 13/025* (2013.01); *A45F 3/14* (2013.01); *A45F 3/04* (2013.01); *A45F 2003/146* (2013.01)

(58) Field of Classification Search

CPC ..... A47D 13/025; A47D 13/02
USPC ..... 224/158–160, 578–583
See application file for complete search history.

(56) References Cited

U.S. PATENT DOCUMENTS

| | | | | |
|---|---|---|---|---|
| 4,333,591 A | | 6/1982 | Case | |
| 5,025,965 A | | 6/1991 | Smith | |
| 5,195,666 A | | 3/1993 | Yamaguchi et al. | |
| 5,292,042 A | | 3/1994 | Yamaguchi et al. | |
| 5,641,101 A | | 6/1997 | Nakayama | |
| 5,649,658 A | | 7/1997 | Hoffman et al. | |
| 5,657,912 A | | 8/1997 | Nakayama | |
| 5,685,466 A | * | 11/1997 | Hsieh | A47D 13/025 224/159 |

(Continued)

FOREIGN PATENT DOCUMENTS

EP 722684 A1 7/1996

OTHER PUBLICATIONS

International Search Report and Written Opinion for PCT/US2018/50927, dated Dec. 3, 2018.

*Primary Examiner* — Adam J Waggenspack
(74) *Attorney, Agent, or Firm* — Stetina Brunda Garred & Brucker

(57) ABSTRACT

An adaptable child carrier system includes a harness having a pair of shoulder straps extendable over the wearer's shoulders and a lower panel extendable over a portion of the wearer's back. A primary support is selectively attachable to the harness. A pair of connecting straps extend between the primary support and the shoulder straps. The child carrier system is selectively transitionable between a first and second wearing modes without re-orientation, removal, reversal or modification of the harness part. In the first wearing mode, the primary support is attached to the pair of shoulder straps such that the lower panel and the primary support are separated from each other so as to reside on opposed sides of the wearer's torso when worn by the wearer. In the second wearing mode, the primary support is attached to the lower panel to define a cavity to receive the child for carrying the child adjacent the wearer's back.

16 Claims, 22 Drawing Sheets

(56) References Cited

U.S. PATENT DOCUMENTS

| | | | | |
|---|---|---|---|---|
| 5,711,466 | A | 1/1998 | Kataoka et al. | |
| 5,934,528 | A | 8/1999 | Higuchi | |
| 6,325,259 | B1 | 12/2001 | Tharalson et al. | |
| 6,619,519 | B1 | 9/2003 | Nix et al. | |
| 6,655,565 | B2 | 12/2003 | Godshaw et al. | |
| 6,763,983 | B2 | 7/2004 | Norman | |
| 6,866,173 | B2 | 3/2005 | Haber | |
| 7,322,498 | B2 | 1/2008 | Frost | |
| 7,484,645 | B2 | 2/2009 | Hoff et al. | |
| 7,614,533 | B2 | 11/2009 | Boal et al. | |
| 7,942,296 | B1 | 5/2011 | Johnson | |
| 8,001,803 | B2 | 8/2011 | Kanagaki | |
| 8,490,230 | B2 | 7/2013 | Rovin | |
| 8,752,739 | B2 | 6/2014 | Bergkvist et al. | |
| D712,134 | S | 9/2014 | Gunter et al. | |
| 8,998,051 | B2 | 4/2015 | Demskey | |
| 9,295,341 | B2 | 3/2016 | Sonnenberg | |
| 9,439,515 | B2 | 9/2016 | Kim | |
| 9,801,451 | B2 | 10/2017 | Murdoch et al. | |
| 2004/0149790 | A1* | 8/2004 | Kassai | A47D 13/02 224/160 |
| 2007/0228091 | A1 | 10/2007 | Shawen | |
| 2009/0206116 | A1 | 8/2009 | Grant | |
| 2009/0321481 | A1 | 12/2009 | Licausi | |
| 2015/0201761 | A1* | 7/2015 | Wollenberg | A47D 13/025 224/576 |
| 2018/0008024 | A1 | 1/2018 | Barton | |

* cited by examiner

ADAPTABLE CHILD CARRIER SYSTEM

CROSS-REFERENCE TO RELATED APPLICATIONS

The present application claims the benefit of U.S. Provisional Application No. 62/557,926, filed Sep. 13, 2017, the entirety of which is expressly incorporated herein by reference.

STATEMENT RE: FEDERALLY SPONSORED RESEARCH/DEVELOPMENT

Not Applicable

BACKGROUND

1. Technical Field

The present disclosure relates generally to a child carrier, and more specifically to a versatile child carrier system capable of being used in several carrier modes.

2. Description of the Related Art

Child carriers are widely used by parents or other caregivers to carry a child in a manner which provides a certain degree of support to the parent, while at the same time comfortably supporting the child. To that end, several different types of child carriers have been developed. One conventional child carrier is a "pouch sling," which typically includes a simple tube of fabric which is worn over one shoulder. Pouch slings are typically sized to fit and are not adjustable.

Another conventional child carrier is commonly referred to as a "ring sling," which may be similar to a pouch sling, but include two rings, typically of metal or nylon, and through which the ends of the fabric are threaded. Ring slings may allow for adjustment of the sling based on the size and comfort of the wearer and the child, although ring slings may be difficult to initially set up, and may be limited in the positions in which the sling may be worn on the wearer.

"Mei Tai" carriers are yet another form of conventional child carrier, which may be a semi-structured sling. Mei Tai carriers may be used for front, back and hip carrying, and may include carrier straps which are tied around the wearer to provide for an adjustable fit. However, Mei Tai carriers may not be configurable to allow a child to face outwardly, where the child's back is placed adjacent the wearer's chest.

"Wrap" type carriers can be used for front, back, and hip carrying, and may allow for adjustment, although such carriers may be difficult to use. In this regard, it may be difficult for the wearer to tie the wrap around the child, as well as their own shoulders and waist.

"Active" carriers may refer to soft-structured carriers which are generally intended for front and back carrying. Active carriers may include shoulder straps and a padded waistband.

"Backpack" carriers typically refer to carriers intended for outdoor use. Such carriers typically include a metal frame and are designed to be ergonomic for long hikes.

In this regard, while there are several options of conventional child carriers, each option suffers from certain drawbacks, which may include limited operational modes, or difficulty in use.

Accordingly, there is a need in the art for an improved carrier that is easy to use and is transitional to different modes of use. Various aspects of the present disclosure address this particular need, as will be discussed in more detail below.

BRIEF SUMMARY

In accordance with one embodiment of the present disclosure, a child carrier system is provided which is configurable for use in several different operational modes, allowing a wearer to carry the child in several different positions and orientations. In this regard, the child carrier system integrates several of the desirable features of different types of conventional child carriers into an all-in-one system.

According to one embodiment, there is provided an adaptable child carrier system comprising a harness having a pair of shoulder straps and a lower panel which includes a harness belt, with the pair of shoulder straps extending from the lower panel. The harness is wearable by a wearer with the pair of shoulder straps extending over respective ones of the wearer's shoulders, the lower panel extending over a portion of the wearer's back, and the harness belt extending about the wearer's waist. A primary support is selectively attachable to the harness. A pair of connecting straps extend between the primary support and the shoulder straps. The child carrier system is selectively transitionable between a first wearing mode (e.g., a first configuration), and a second wearing mode (e.g., a second configuration). In the first configuration, the primary support is attached to the pair of shoulder straps such that the lower panel and the primary support are separated from each other so as to reside on opposed sides of the wearer's torso when worn by the wearer. In the second configuration, the primary support is attached to the lower panel to define a cavity to receive the child for carrying the child adjacent the wearer's back.

The child carrier system may additionally include a waist pad detachably engageable with the primary panel and having a second waist belt portion selectively engageable with the harness belt portion to extend around a wearer. The primary support may include a first fastener and the waist pad may include a second fastener selectively engageable with the first fastener. The harness may include a third fastener engageable with the first fastener when the child carrier system is in the first configuration. The first and second fasteners may include cooperatively engageable zipper components, and the first and third fasteners may include cooperatively engageable zipper components.

The first pair of connecting straps may include a first segment slidably coupled to a respective one of the pair of shoulder straps. The child carrier may additionally include a pair of rails connected to respective ones of the first pair of connecting straps.

The child carrier system may further comprise a first set of loops connected to a first one of the pair of shoulder straps and a second set of loops connected to a second one of the pair of shoulder straps. The child carrier system may include a second pair of connecting straps connectable to the loops and the primary support.

The child carrier system may additionally include a crotch support coupled to primary support.

The child carrier system may further comprise a storage pack, backpack, or day pack detachably engageable with the harness. The child carrier system may be transitional to a third configuration wherein the storage pack, backpack or day pack is engaged with the harness.

The present disclosure will be best understood by reference to the following detailed description when read in conjunction with the accompanying drawings.

BRIEF DESCRIPTION OF THE DRAWINGS

These and other features and advantages of the various embodiments disclosed herein will be better understood with respect to the following description and drawings, in which.

Common reference numerals are used throughout the drawings and the detailed description to indicate the same elements.

DETAILED DESCRIPTION

Figure 1:
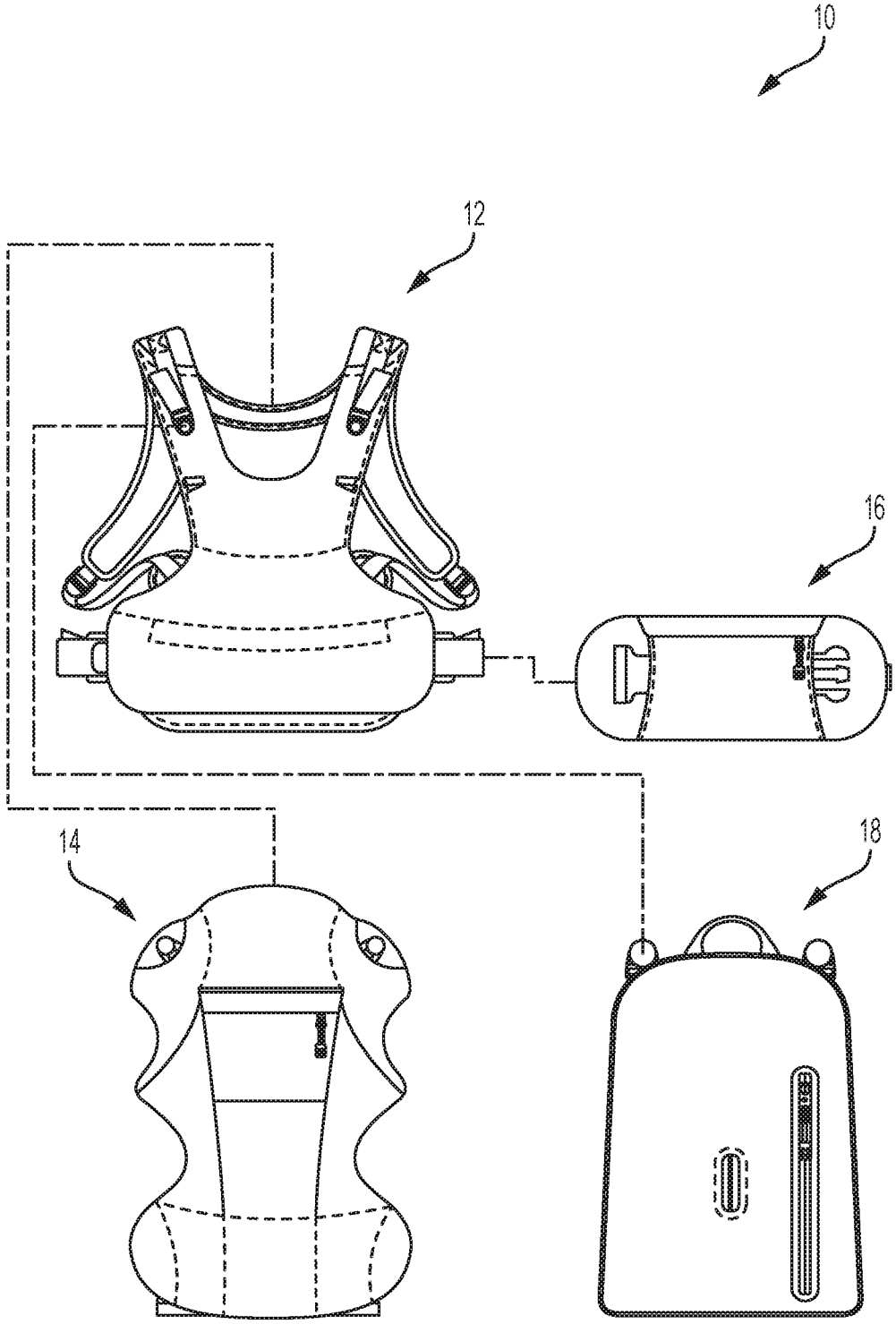
FIG. 1 is a front view of a harness, a primary support, a waist pad and a day pack, which are included in a child carrying system.

The detailed description set forth below in connection with the appended drawings is intended as a description of certain embodiments of an adaptable child carrier system and is not intended to represent the only forms that may be developed or utilized. The description sets forth the various structure and/or functions in connection with the illustrated embodiments, but it is to be understood, however, that the same or equivalent structure and/or functions may be accomplished by different embodiments that are also intended to be encompassed within the scope of the present disclosure. It is further understood that the use of relational terms such as first and second, and the like are used solely to distinguish one entity from another without necessarily requiring or implying any actual such relationship or order between such entities.

Referring now to the drawings, wherein the showings are for purposes of illustrating a preferred embodiment of the present disclosure, and are not for purposes of limiting the same, there is depicted a child carrying system 10. The child carrying system 10 is extremely versatile, and allows a parent, caregiver, etc., to operate in several different carrying modes, including a pair of front carry modes, as well as a back-carry mode. The child carrying system 10 may include one or more accessories, such as a clip-on backpack or day pack, a newborn insert, a dribble bib, and a hood, as will be explained in more detail below.

Figure 2:
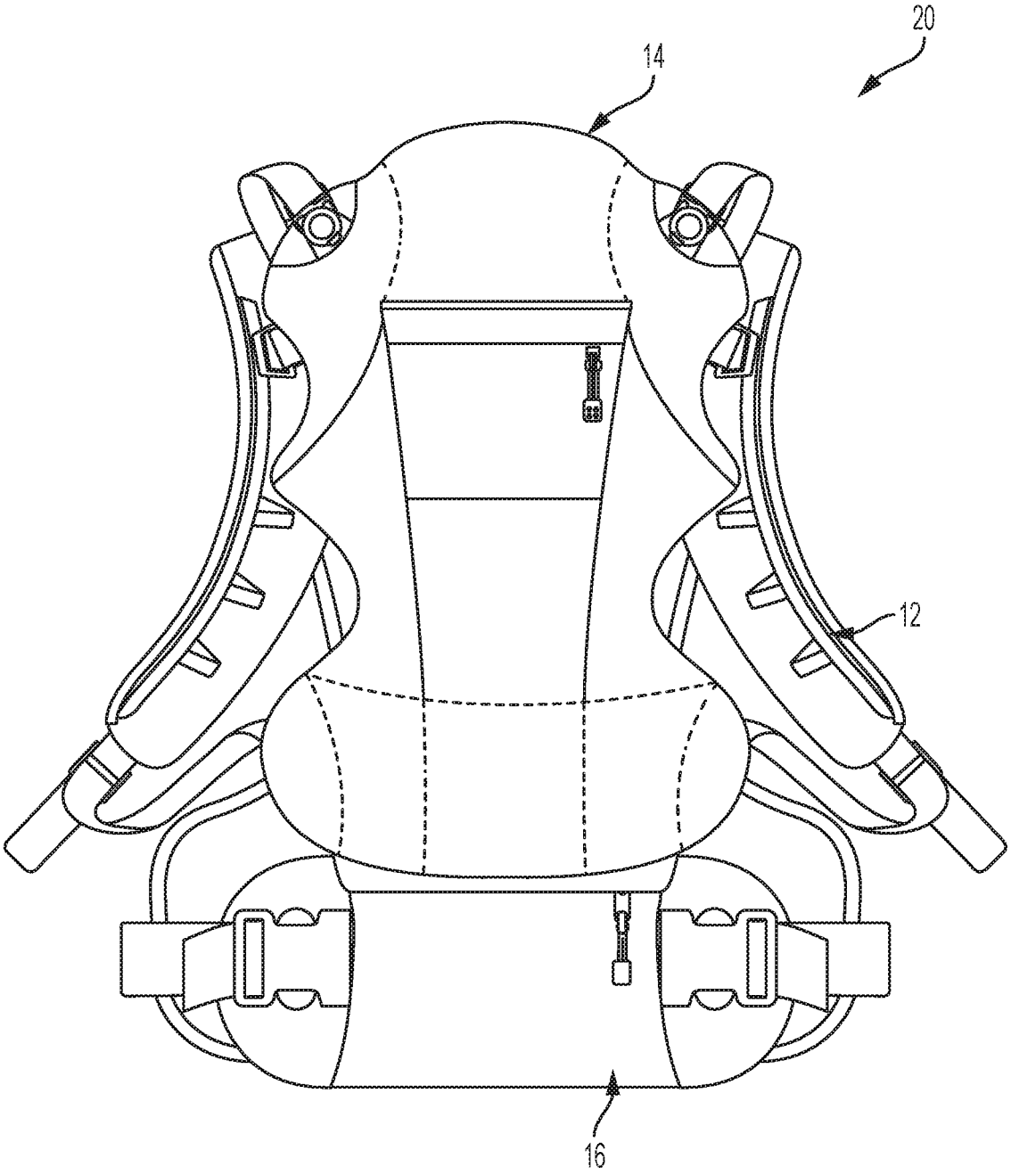
FIG. 2 is a front view of a child carrier assembled using components of the child carrying system including the harness, the primary support and the waist pad.

As shown in FIG. 1, one embodiment of the carrying system 10 includes a harness 12, a primary support 14, a waist pad 16, and a day pack 18. The components of the carrying system 10 may be connected to each other in a variety of different wearing modes or configurations depending on the size of the child, as well as the desired functionality to be provided to the wearer. FIG. 2 shows the harness 12, primary support 14, and waist pad 16 connected to each other to define a carrier 20 for carrying the child on the wearer. As will be explained below, the harness 12, primary support 14, and waist pad 16 may be selectively transitioned between several different configurations, with each configuration being associated with a different operational mode. Before discussing the particulars of the different operational modes, the structural details of each component of the carrying system 10 will be described.

Figure 3:
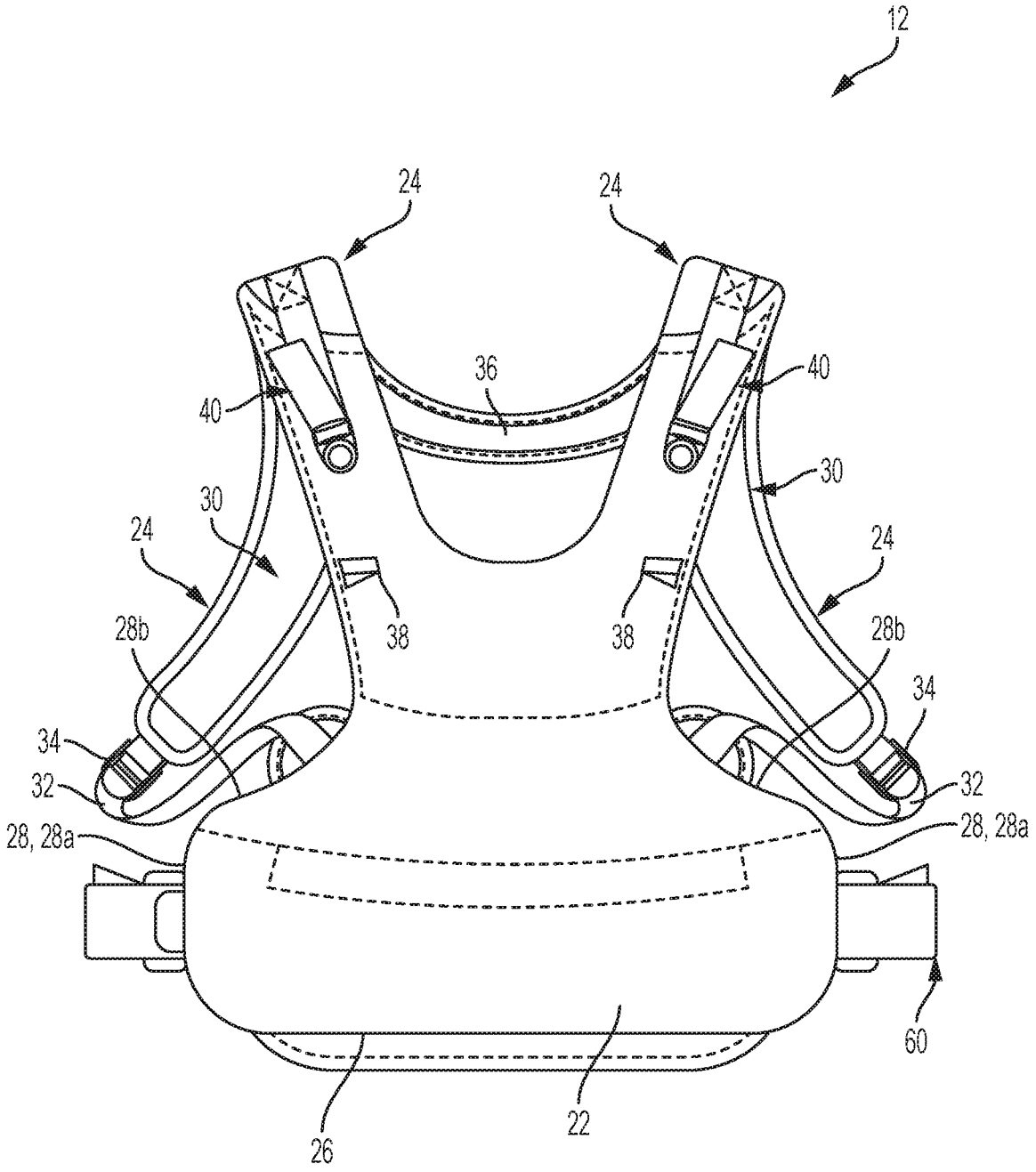
FIG. 3 is a front view of the harness.

The harness 12 includes a lower panel 22 and a pair of shoulder straps 24 connected to the lower panel 22. When viewed from the perspective shown in FIG. 3, the lower panel 22 includes a lower edge 26 and a pair of side edges 28 which extend upwardly from the lower edge 26. The distance between the side edges 28 varies, such that the lower panel 22 defines a maximum width at a lower portion thereof and a minimum width proximate the shoulder straps 24. The segments of the side edges 28 extending along the maximum width region are referred to as maximum width segments 28*a*, while the segments of the side edges 28 extending from the maximum width region toward the minimum width region are referred to as narrowing segments 28*b*. The lower panel 22 may include a zipper track 25, which may allow for attachment of the primary support 14 thereto to configure the carrier 20 for use in a back-carry mode, as will be described in more detail below. An enlargement shown in FIG. 4 shows the zipper track 25, which may be recessed below a flap 27 to partially conceal the zipper track 25.

Each shoulder strap 24 includes a padded element 30 and a strap element 32. Each padded element 30 extends from the lower panel 22, and in some instances, may be a continuous extension of the lower panel 22, with each padded element 30 terminating at a distal end portion. The padded elements 30 may extend from the lower panel 22 in non-parallel relation to each other. A buckle 34 or other securing device may be coupled to the distal end portion of each padded element 30. A transverse support 36 may extend between the padded elements 30 to provide lateral support to the padded elements 30, i.e., to mitigate separation of the padded elements 30 beyond a defined threshold. The strap element 32 may include a fixed end portion coupled to the lower panel 22 and extending from respective narrowing segments 28*b* thereof, and a free end portion opposite the fixed end portion. The strap element 32 may be threaded through the buckle 34 to connect the strap element 32 to the padded element 30 and to complete a loop, which is collectively defined by the lower panel 22, the padded element 30, and the strap element 32. The buckle 34 is moveable along the strap element 32 to allow for selective size adjustment of the loop. The loop may extend over a respective one of the wearer's shoulders to allow the harness 12 to be supported by the wearer's shoulders and rest over the wearer's torso. In this respect, when the harness 12 is worn by the wearer, the wearer's neck extends upwardly between the padded elements 30 of the shoulder straps 24.

The harness 12 may additionally include several straps, buckles, and loops to allow for connection of the primary support 14 thereto in several different configurations, as well as to facilitate connection of the waist pad 16 and day pack 18.

Figure 4:
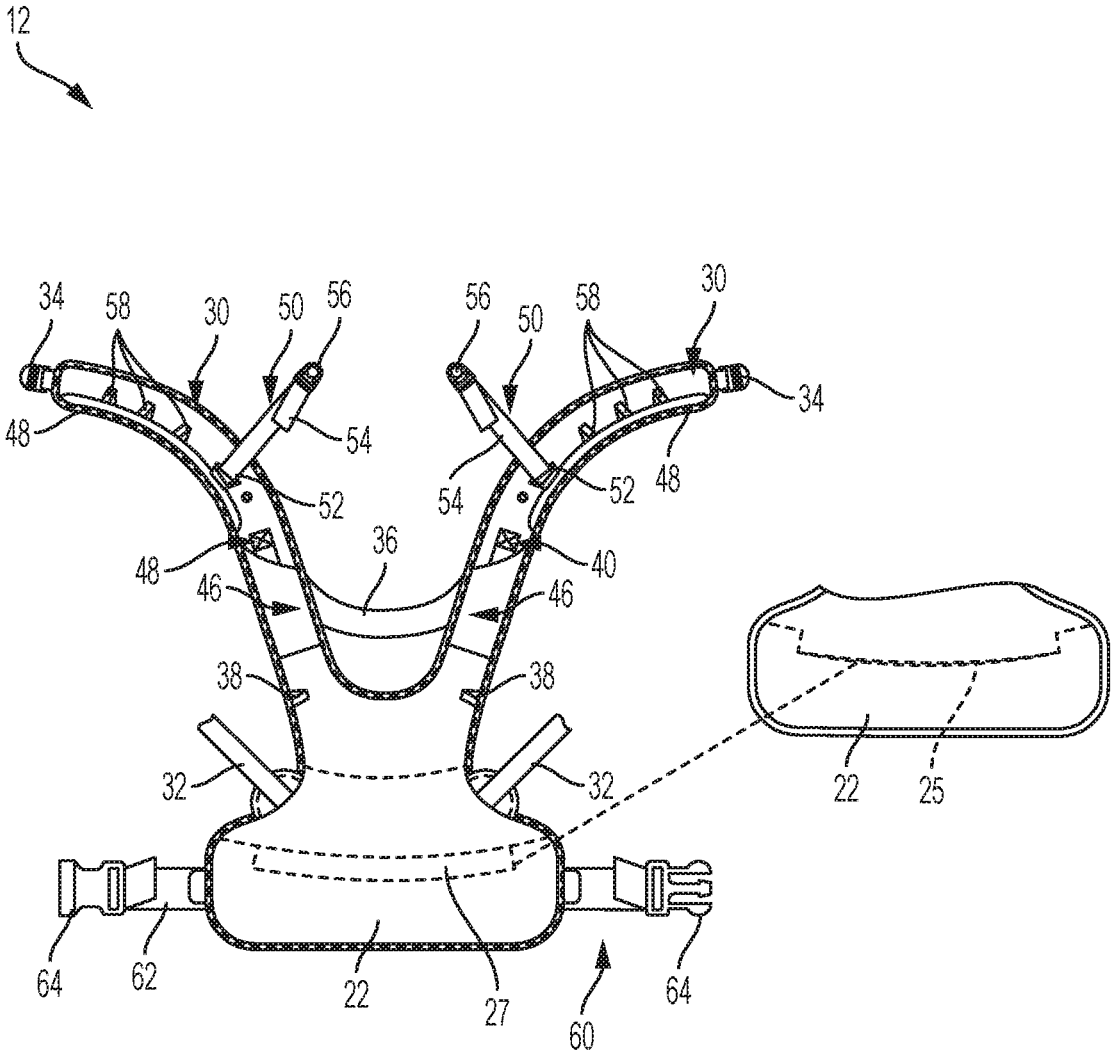
FIG. 4 is a front view of the harness with shoulder straps being elongated for illustration, and a pair of straps being retained within pockets formed on the shoulder straps.
Figure 5:
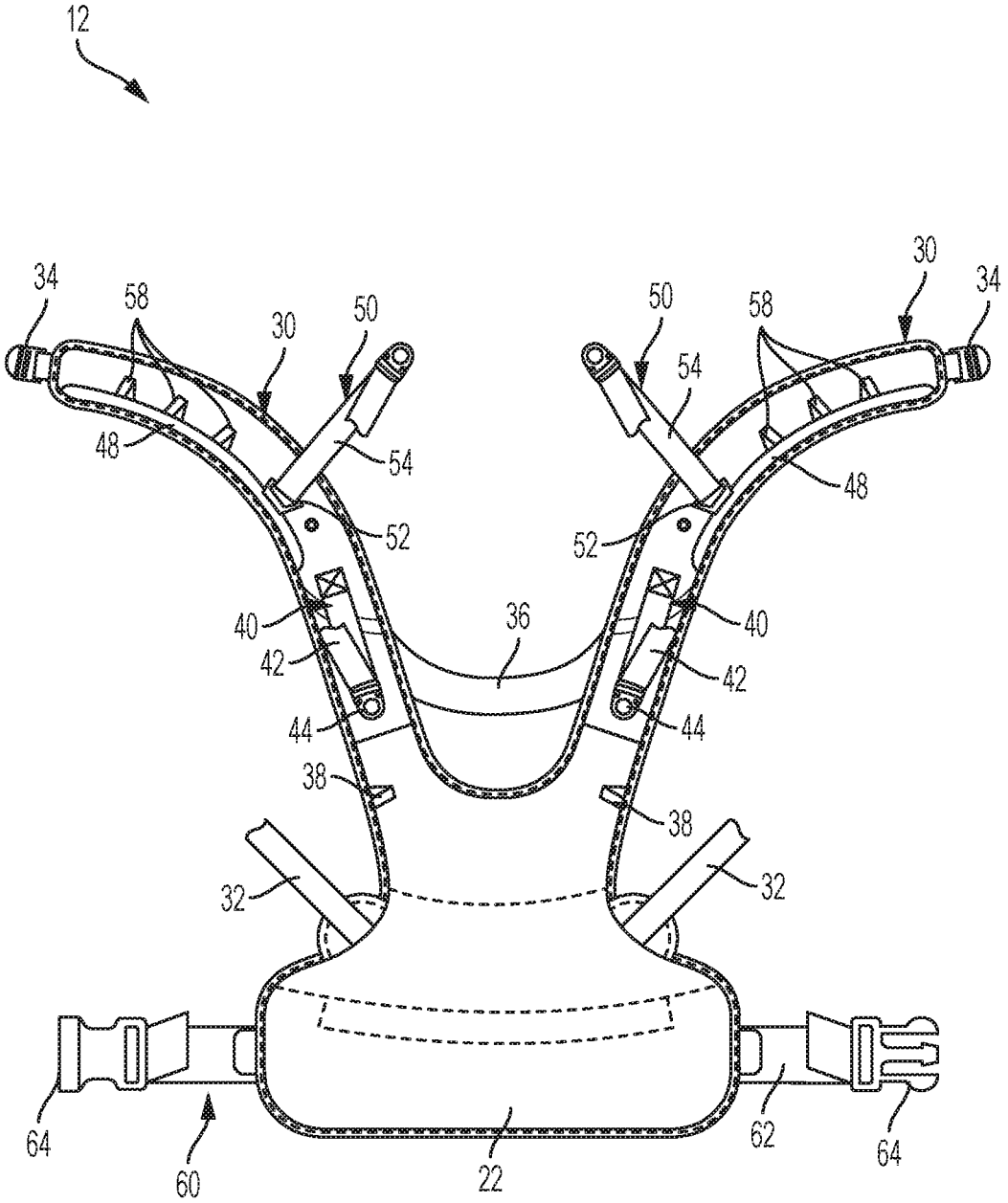
FIG. 5 is a front view of the harness with the pair of straps being removed from pockets formed on the shoulder straps.

Referring now specifically to FIGS. 4 and 5, the harness 12 is shown with the padded elements 30 detached from the strap elements 32 to more clearly illustrate the structural elements connected to the padded elements 30. Starting at the lower panel 22 and moving toward the distal end portions of the padded elements 30, the harness 12 includes a pair of rear mounting loops 38 located adjacent respective ones of opposed edges of the harness 12. According to one embodiment, the rear mounting loops 38 are located in the region of the harness 12 where the padded elements 30 connect with the lower panel 22.

The harness 12 additionally includes a pair of first straps 40, which may be fixedly coupled to respective ones of the padded elements 30. Each first strap 40 may include a strap element 42 and a buckle 44 connected to a distal end portion of the strap element 42. The position of the buckle 44 along the strap element 42 may be adjusted to allow for length adjustment of the corresponding first strap 40. The buckles 44 and at least portions of the strap elements 42 may be concealed in respective pockets defined by respective pocket bodies 46, each of which is connected to and extends over a portion of the corresponding padded element 30. An upper edge of each pocket body 46 may have elastic binding to allow the opening defined by the upper edge to expand for facilitating insertion and removal of the corresponding first strap 40. In particular, when the first strap 40 is not being used, the first strap 40 may be placed within the corresponding pocket, as is shown in FIG. 4. The wearer may easily remove the first strap 40 from the pocket, as shown in FIG. 5, to use the first strap 40.

The harness 12 additionally includes a pair of rails 48 or piping extending along respective ones of the padded elements 30. Each rail 48 may extend longitudinally along a given padded element 30 and may include one end adjacent the distal end of the respective padded element 30, and another end adjacent the corresponding first strap 40. Each rail 48 may also be positioned adjacent a lateral edge of the corresponding padded element 30.

A pair of second straps 50 are connected to respective ones of the pair of rails 48. Each second strap 50 includes a slider 52, a strap element 54, and a buckle 56. The slider 52 is translatable along the corresponding rail 48 to allow for positional adjustment of the second strap 50 relative to the corresponding shoulder strap 24. The strap element 54 extends between the slider 52 and the buckle 56, with the position of the buckle 56 being adjustable relative to the strap element 54 to adjust the effective length of the second strap 50. In particular, the effective length is the distance along the strap element 54 between the slider 52 and the buckle 56.

The harness 12 further includes a plurality of mounting loops 58 on each shoulder strap 24. As shown in FIGS. 4 and 5, each shoulders strap 24 includes three mounting loops 58, which may be coupled to the rail 48 or directly to the padded element 30. The mounting loops 58 are spaced along the shoulder strap 24 to provide different points of attachment for a pair of third straps, as will be described in more detail below. According to one embodiment, the mounting loops 58 are equally spaced apart along the corresponding shoulder strap 24.

The harness 12 additionally includes a harness belt 60 coupled to the lower panel 22 and extending from opposed sides thereof. The harness belt 60 includes a belt body 62 and a pair of cooperating connectors 64. The belt body 62 may be comprised of a single segment having a length sufficient to extend from opposed sides of the lower panel 22 and around the wearer. As an alternative, the belt body 62 may be comprised of a pair of segments extending from respective sides of the lower panel 22. The belt body 62 includes a pair of end portions coupled to respective ones of the pair of connectors 64. At least one connector 64, and preferably both connectors 64, are translatable along the belt body 62 to allow for adjustment. The harness belt 60 may be extendable around the waist of the wearer, with the connectors 64 being connectable to each other to secure the harness belt 60 around the wearer. It is also contemplated that in certain operational modes, the harness belt 60 may not extend around the wearer, but instead, may connect with other components, as will be described in more detail below.

Figure 6:
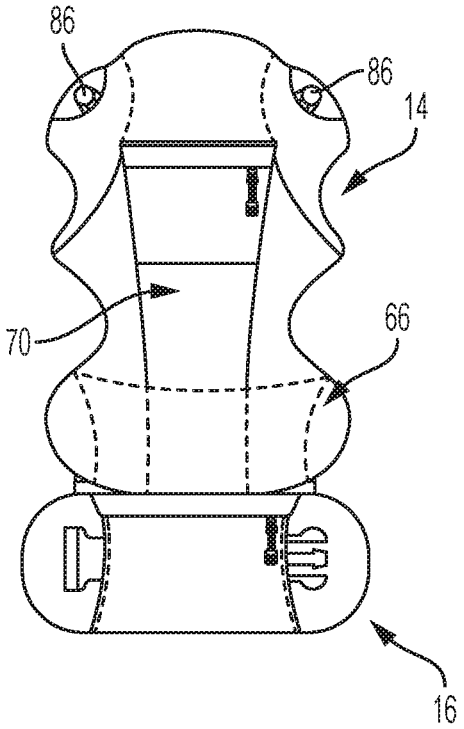
FIG. 6 is a front view of the primary support connected to the waist pad.

Referring now to FIGS. 6-10, the details of the primary support 14 will now be discussed. In FIG. 6, the primary support 14 is connected to the waist pad 16, while FIGS. 7-10 show the primary support 14 by itself. The primary support 14 includes a main body 66 having an inner surface 68 and an opposing outer surface 70. The main body 66 is segregated into an upper portion 72 and a lower portion 74. The upper portion 72 may be pivotable or foldable relative to the lower portion 74 about a crease 76 or fold line. The peripheral contour of the primary support 14 may be designed to allow for arm openings or leg openings when the primary support 14 is connected to harness 12. In this regard, the primary support 14 is symmetrical about a longitudinal axis 78, and includes a pair of upper recesses 80 and a pair of intermediate recesses 82 formed along the lateral edges thereof. Below the intermediate recesses 82 is an enlarged region, which may be sized and structured to support the midsection of the child.

Figure 7:
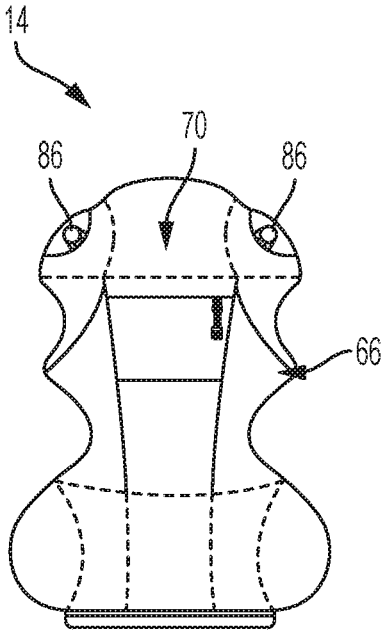
FIG. 7 is a front view of the primary support.

The primary support 14 includes a plurality of connectors coupled thereto. A pair of upper connectors 86 are coupled to respective lateral regions of the upper portion 72 of the primary support 14 and a pair of lower connectors 88 are coupled to respective lateral regions of the lower portion 74 of the primary support 14. The upper connectors 86 and the lower connectors 88 may reside within respective pockets formed on the primary support 14. In this regard, each connector 86, 88 may be fully or partially shielded by a corresponding cover panel that forms the respective pocket within which each connector 86, 88 resides. As shown in FIG. 7, the upper connectors 86 are only partially concealed by the respective covers, while the lower connectors 88 are completely concealed by the respective covers.

Figure 8:
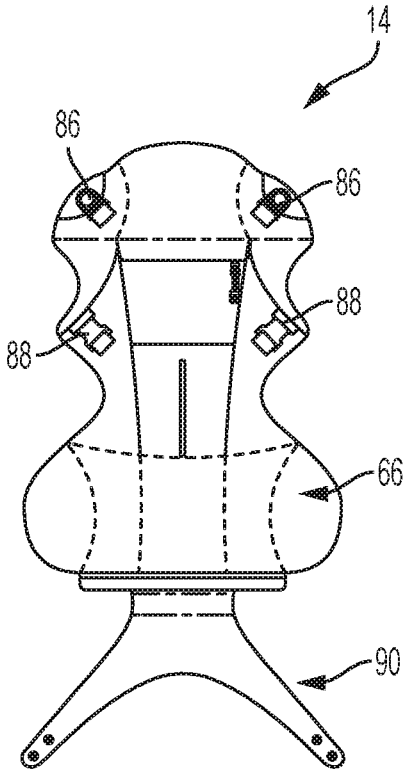
FIG. 8 is a front view of the primary support with a pocket cover being removed to more clearly illustrate two pairs of connectors.
Figure 9:
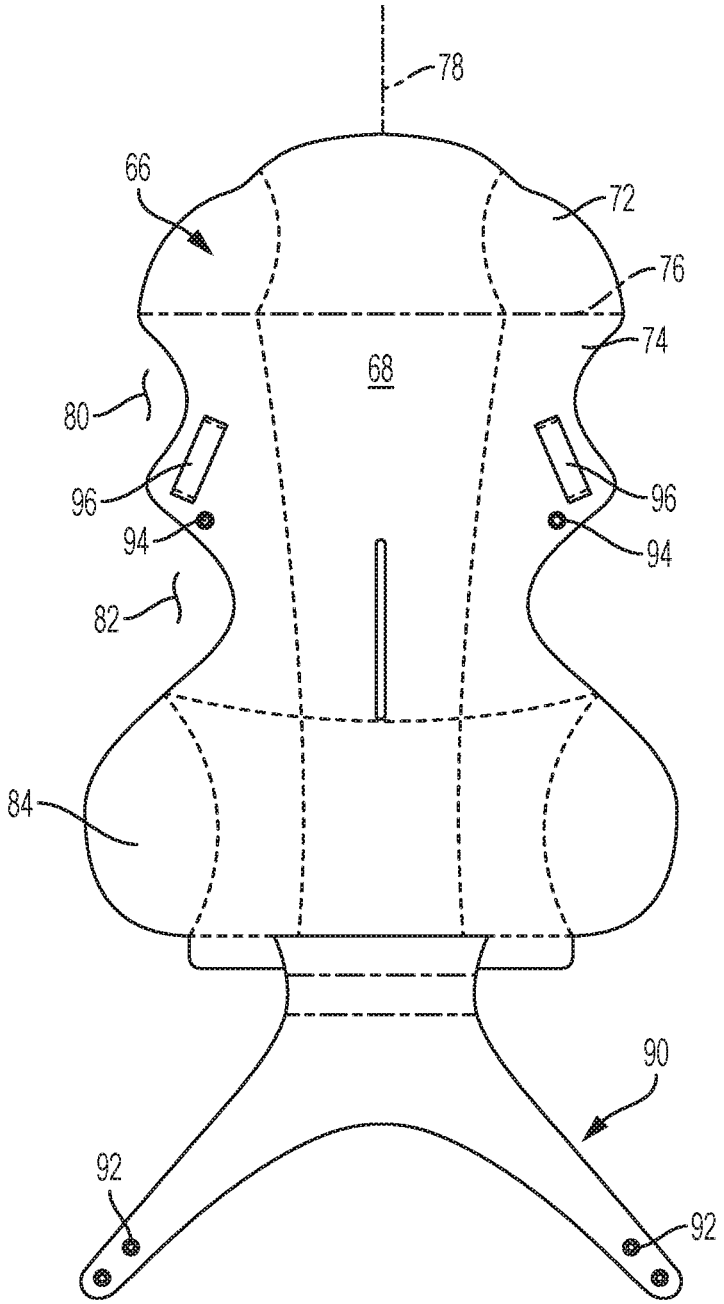
FIG. 9 is a rear view of the primary support.

Referring to FIGS. 8 and 9, the primary support 14 may additionally include a crotch support 90, which may have one end portion fixedly coupled to the main body and a free end portion selectively connectable to the inner surface 68 of the main body 66. The free end portion and the main body 66 may include cooperating fasteners 92, 94, such as snap fasteners or the like, to allow for selective coupling of the free end portion to the main body 66. When the free end portion is connected to the main body 66, the crotch support 90 and the main body 66 may collectively define a seat having a pair of leg openings for supporting the child. Although FIGS. 8 and 9 show the crotch support 90 as having a free end portion which may be disconnected from the main body 66, it is contemplated that in other embodiments, both end portions of the crotch support 90 may be fixedly coupled to the main body 66.

The primary support 14 may also include a pair of loops 96 connected to the inner surface 68 of the main body 66. The pair of loops 96 are intended for use in supporting an infant, as will be discussed below.

Figure 10:
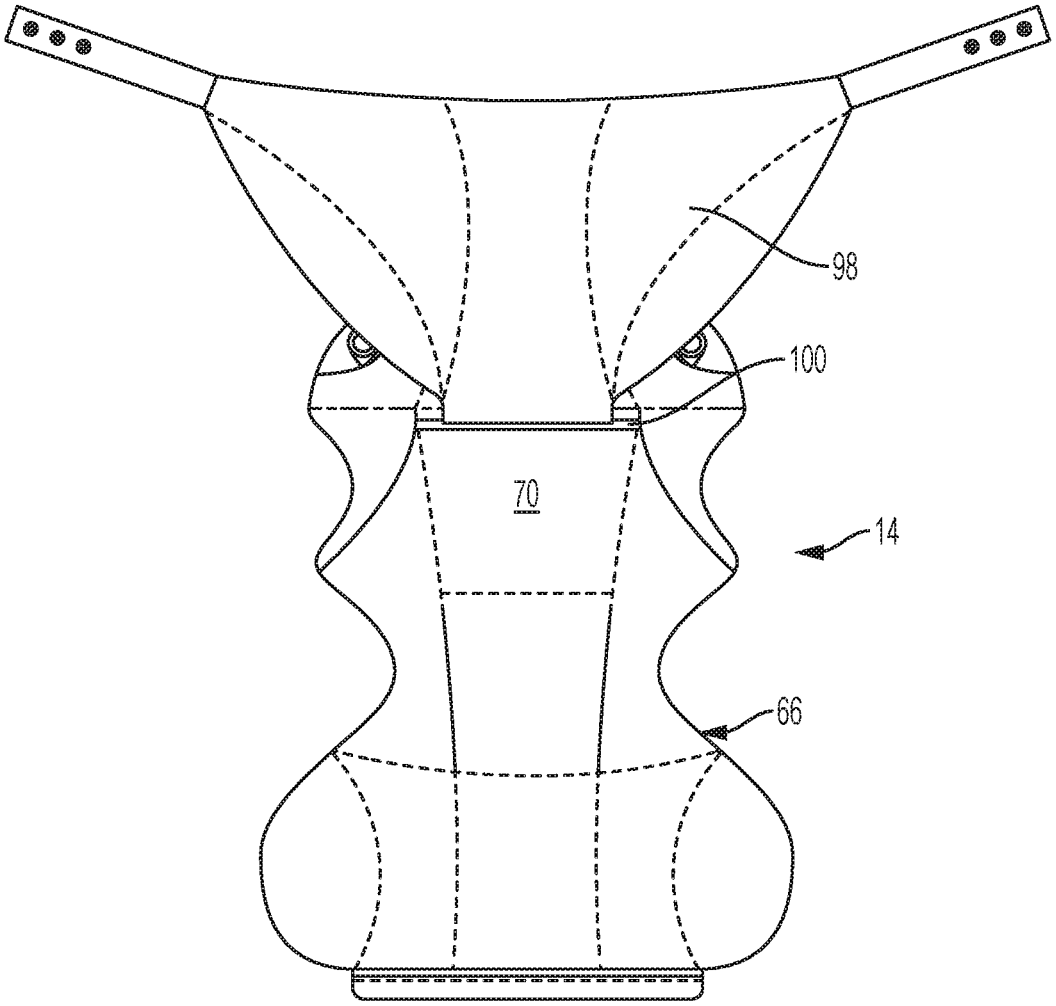
FIG. 10 is a front view of the primary support having a hood deployed therefrom.

Referring now specifically to FIG. 10, the primary support 14 may have a hood 98 coupled to the main body 66 for covering the head of the child seated therein. The hood 98 may be designed to provide shade and UV protection from the sun, as well as protection from rain, snow, or sleet. The hood 98 may be folded and stowed within a pouch or pocket formed within the main body 66 and accessible through a slit on the outer surface 70.

The various modalities in which the system 10 may be used are described in more detail below, although, in general, the primary support 14 may be connected to the harness 12 in several different positions, depending on the particular function and wearing position desired by the wearer. For instance, the primary support 14 may be attached to the harness 12 in spaced relation to the lower panel 22, such that the primary support 14 and lower panel 22 reside on opposite sides of the wearer, with the primary support 14 cradling the child directly against the wearer. Alternatively, the primary support 14 may be connected directly to the lower panel 22 so as to form a cavity which receives the child, with the lower panel 22 residing on one side of the child, and the primary support 14 residing on the other side of the child.

Figure 11:
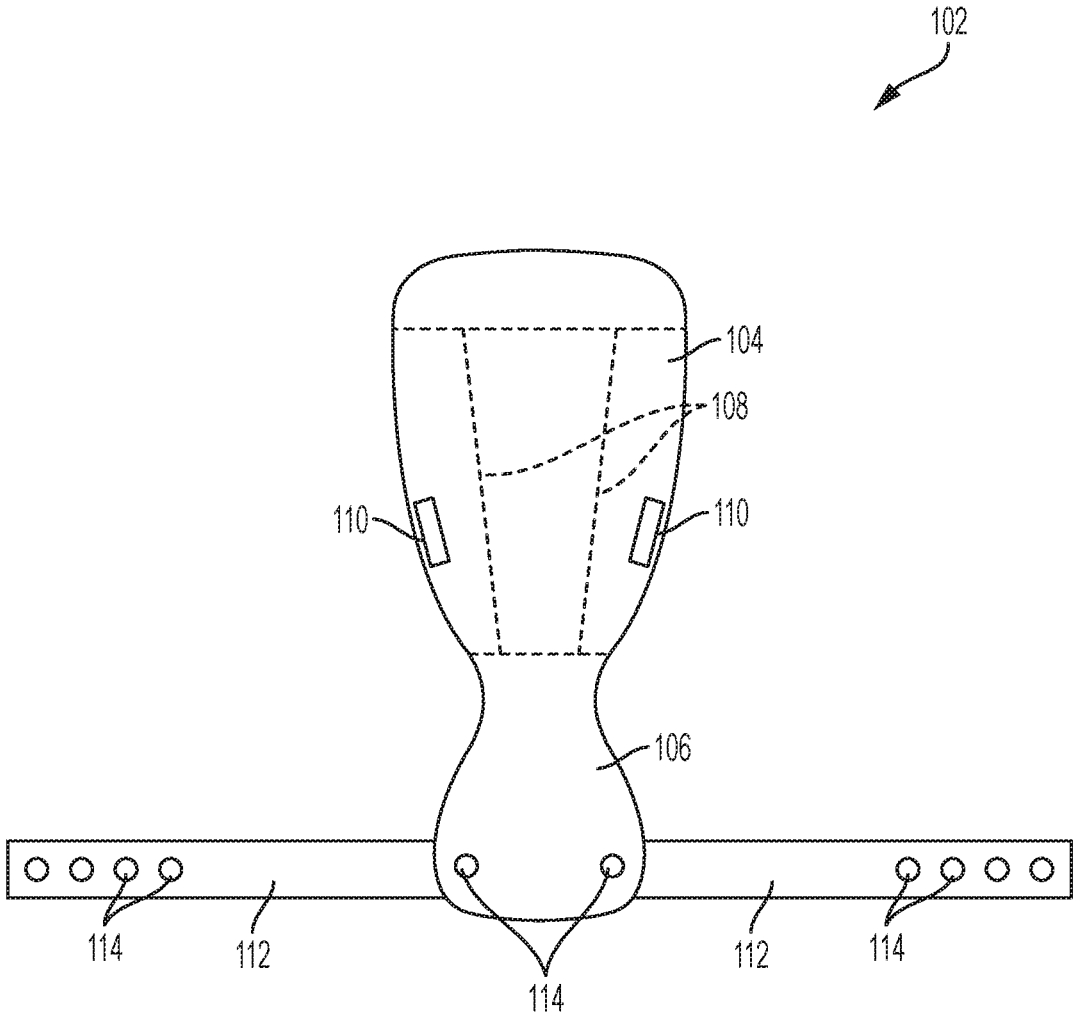
FIG. 11 is a front view of an infant insert.

Referring now to FIG. 11, there is depicted an infant insert 102 configured for use with the primary support 14 to more securely cradle and support newborns or infants within the primary support 14. The infant insert 102 includes a torso support panel 104 and a seat support panel 106 foldable relative to the torso support panel 104. The torso support panel 104 is sized to extend over the torso of the infant, while the seat support panel 106 is sized to extend under the infant to provide lower support to the infant. The seat support panel 106 may include a narrow section which extends under the infant and between the infant's legs. The torso support panel 104 may include one or more fold lines 108 or creases to allow the torso support panel 104 to assume a curved or arcuate configuration to cradle the infant.

The infant insert 102 additionally includes a pair of loops 110 located on an outer surface of the torso support panel 104 adjacent lateral edges thereof. The loops 110 are adapted to receive respective ones of a pair of straps 112, which extend from an end portion of the seat support panel 106. When the seat support panel 106 is folded relative to the torso support panel 104, free ends of the straps 112 are advanced through the loops 110 and secured to the seat support panel 106 via cooperative fasteners 114 located on the seat support panel 106 and the straps 112 to define a pair of leg openings. Each strap 112 includes at least one fastener 114, and in some instances, a plurality of fasteners 114 to allow for selective size adjustment of the leg openings.

Figure 12:
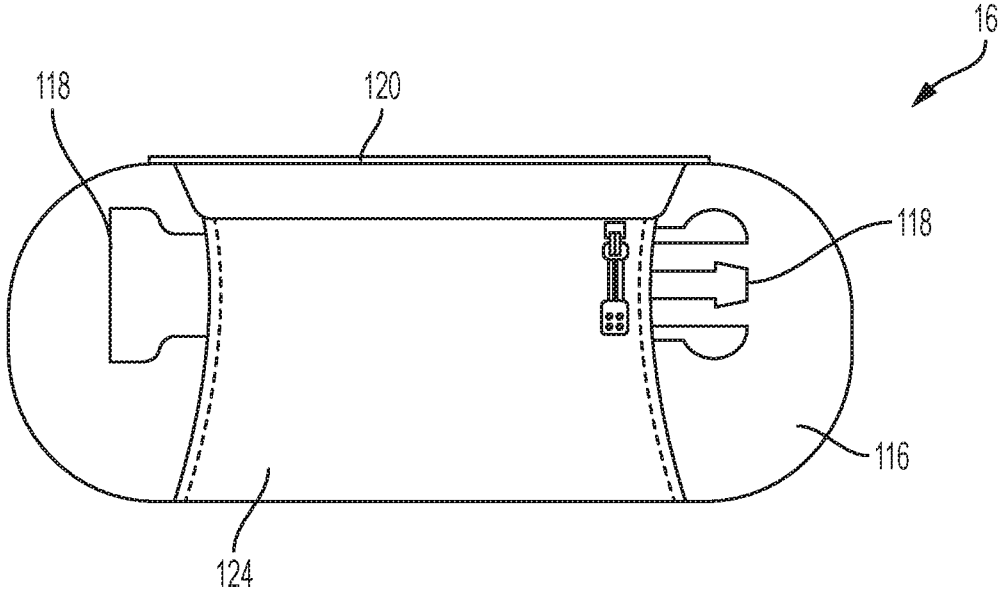
FIG. 12 is a front view of the waist pad.
Figure 13:
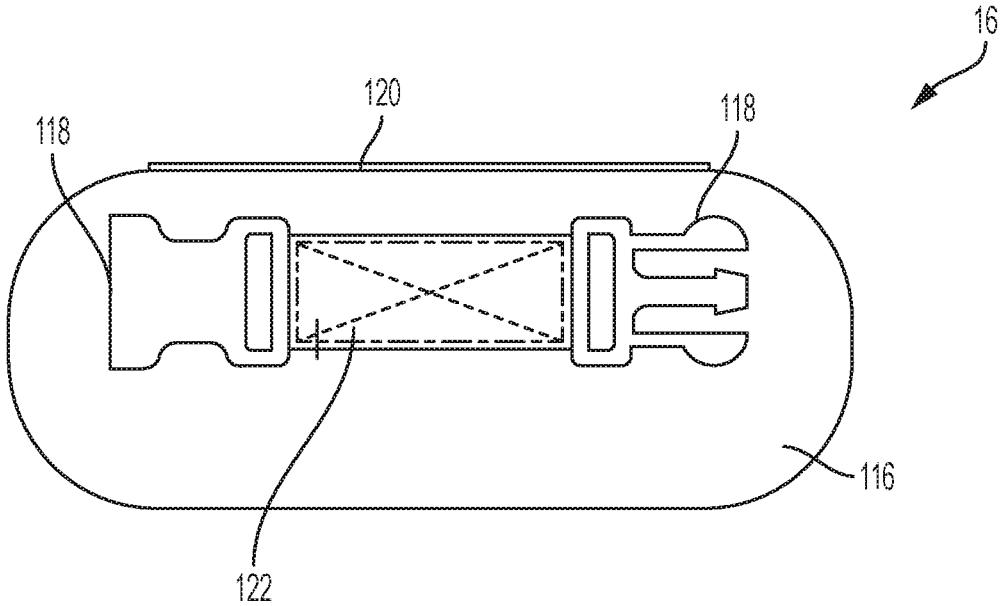
FIG. 13 is a front view of the waist pad, with a cover being removed to depict a strap element.

Referring now to FIGS. 12 and 13, an embodiment of the waist pad 16 is shown. The waist pad 16 includes a main panel 116 having a pair of connectors 118 coupled thereto. The connectors 118 may be connectable with the connectors 64 of the harness belt 60, as will be described in more detail below. The main panel 116 may define a quadrangular or oval shape, and may include a zipper 120 or other attachment mechanism for securing the waist pad 16 to the primary support 14. The connectors 118 are coupled to each other via a strap element 122, which is sewn or otherwise secured to the main panel 116. A cover panel 124 may extend over the strap element 122 and at least partially cover the connectors 118, as shown in FIG. 12. The cover panel 124 has been removed in FIG. 13 to more clearly depict the strap element 122. The cover panel 124 may include a pocket, which may be accessible via a zipper or other closure member.

Figure 14:
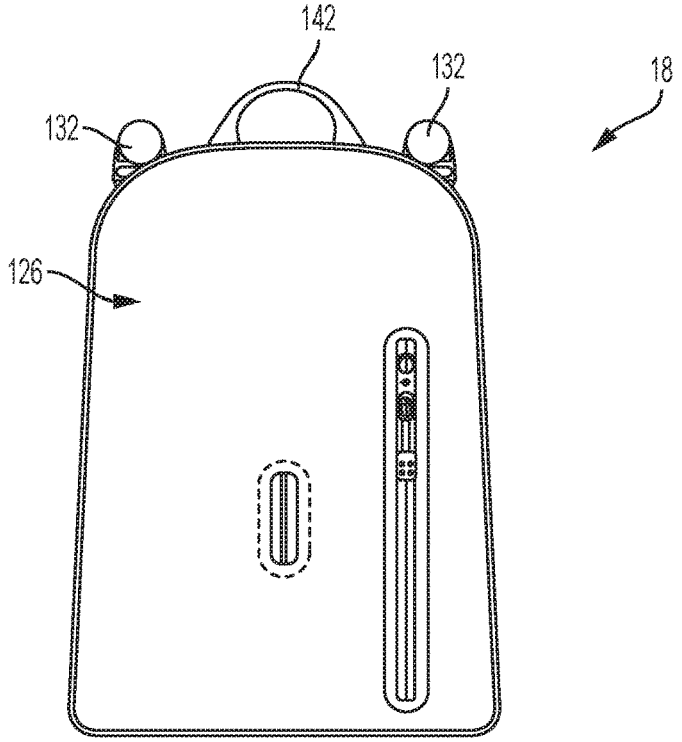
FIG. 14 is a rear view of the day pack.
Figure 15A:
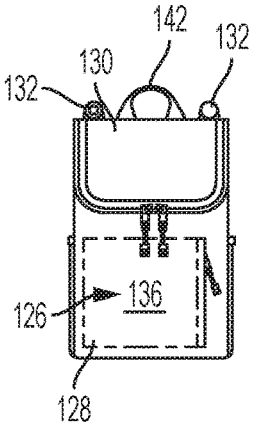
FIGS. 15A-F depicts various views of a day pack.
Figure 15B:
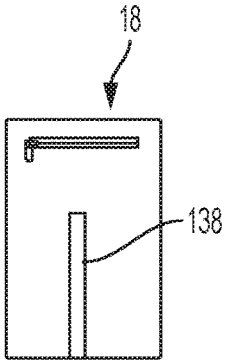
Figure 15C:
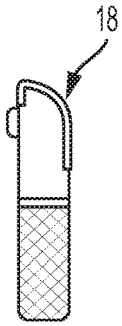
Figure 15D:
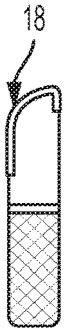
Figure 15E:
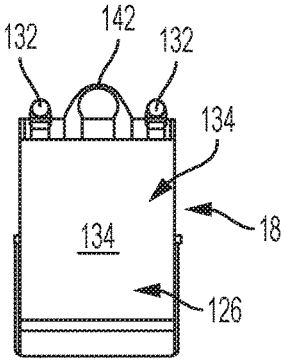
Figure 15F:
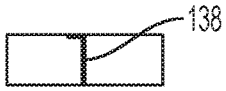
Figure 16A:
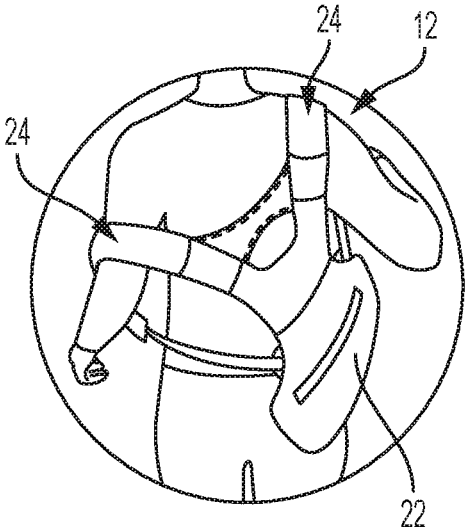
FIGS. 16A-D depicts an exemplary sequence of steps for donning the harness.
Figure 16B:
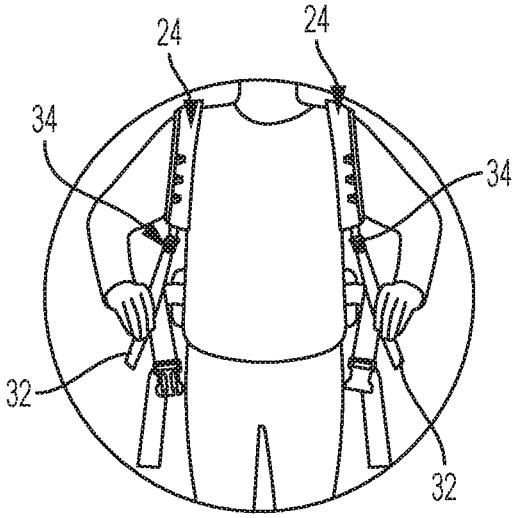
Figure 16C:
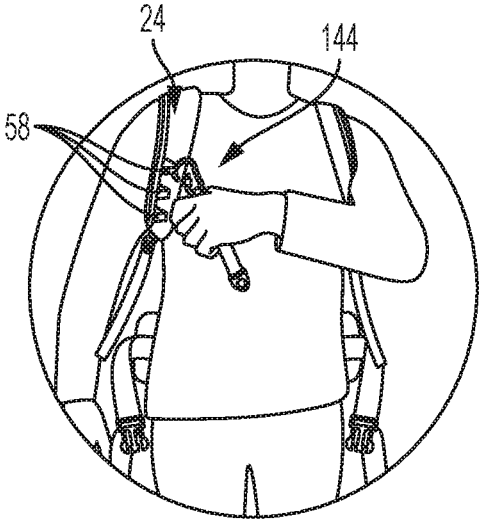
Figure 16D:
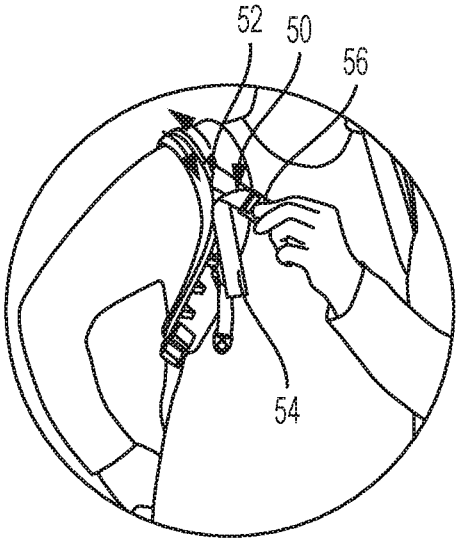

Referring now to FIGS. 14 and 15, an exemplary embodiment of the day pack 18 is depicted. The day pack 18 includes a body 126 having a lower element 128 and a flap 130 having a peripheral edge securable to the lower element 128 via one or more zippers. The flap 130 and lower element 128 collectively define an enclosure for storing items, such as diapers, wipes, food, toys, clothes, blankets, etc. The enclosure may be accessed by detaching the peripheral portion of the flap 130 from the lower element 128 and folding the flap 130 relative to the lower element 12/8 to uncover the enclosure. Alternatively, the enclosure may be closed by securing the peripheral portion of the flap 130 to the lower element 128, causing the flap 130 to extend over the enclosure.

The day pack 18 additionally includes a pair of buckles 132 or clips which are used to secure the day pack 18 to the harness 12, as will be discussed in more detail below. The buckles 132 may be coupled to a rear panel 134 of the body 126, to allow the day pack 18 to "hang" from the harness 12 when the buckles 132 are secured to the harness 12.

The day pack 18 may further include several structural features which may enhance the overall functionality and ease of use of the day pack 18. For instance, the day pack 18 may include a pocket integrated into a front panel 136 of the lower element 128, as shown in FIG. 15(*a*), for storing smaller items, such as keys, or a wallet. The day pack 18 may also include a compartment divider 138 attached to the front panel 136 and/or the opposing rear panel 134 of the lower element 128 for segregating the enclosure into at least two separate regions. Such division may allow a caregiver to separate items as desired by the user. For instance, clean clothes may be separated from dirty clothes, or items intended for use at different times may be stored in the different regions. The day pack 18 may further include a wipes dispenser 140, which include a slit formed in the body 126, with the slit being in communication with a cavity within which wipes may be stored. The day pack 18 may additionally comprise a large storage pocket accessible via an opening in the body 126. The opening may be selectively opened or closed via a zipper connected to the body 126. A handle 142 may extend upwardly from the day pack 18 to facilitate carrying of the day pack 18 when it is not connected to the harness 12.

With the basic structural features of the child carrying system 10 described above, the following discussion will describe the various modes of operation that the child carrying system 10 may be used, including an infant carry mode, a front carry mode, a world facing mode, a back-carry mode, and a day pack carry mode.

In all of the operational modes, the harness 12 is worn by the wearer. FIG. 16 depicts an exemplary sequence of steps for placing the harness 12 on the wearer. As shown in FIGS. 16(*a*)-16(*d*), the wearer dons the harness 12 in a manner similar to donning a backpack, with the wearer placing each arm through a loop defined by a given shoulder strap 24, such that each shoulder strap 24 extends over a respective shoulder. When the harness 12 is properly worn by the wearer, the lower panel 22 extends over a portion of the wearer's lower back. The wearer then pulls on the free ends of the strap elements 32 to tighten the shoulder straps 24 onto the wearer, as shown in FIG. 16(*b*). It is also contemplated that the wearer may slide the buckles 34 along the strap elements 32 to loosen the shoulder straps 24 on the wearer. A pair of detachable straps 144 are connected to respective ones of the shoulder straps, and in particular to the mounting loops 58, as shown in FIG. 16(*c*). Each detachable strap 144 may include a carabiner or other hooking mechanism coupled to a strap element, with the carabiner allowing the detachable strap 144 to be detachably coupled to a loop on the harness 12. The second straps 50 are adjusted according to the size of the wearer, as shown in FIG. 16(*d*). The second straps 50 are moved higher up the corresponding shoulder strap 24 for shorter wearers, and moved lower on the corresponding shoulder strap 24 for taller wearers.

Figure 17A:
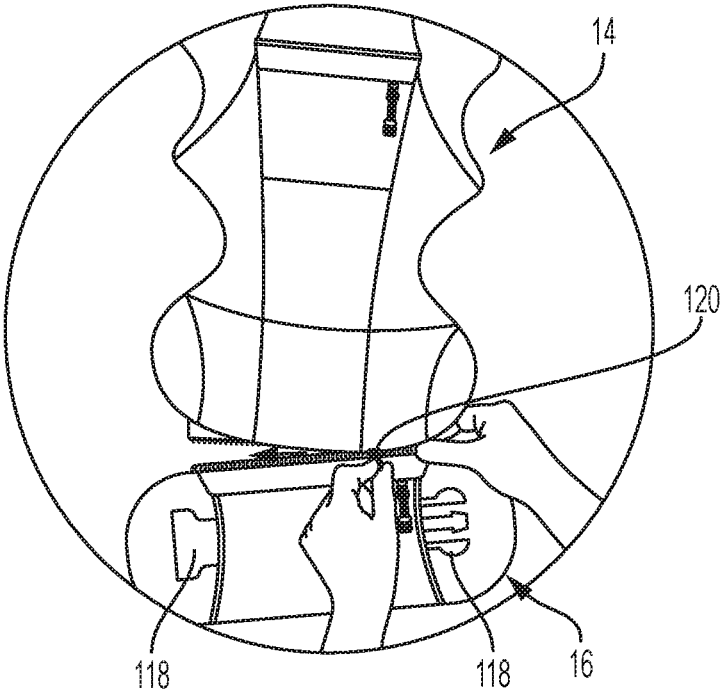
FIGS. 17A-B depicts an exemplary sequence of steps for connecting the primary support and waist pad together and to a harness belt.
Figure 17B:
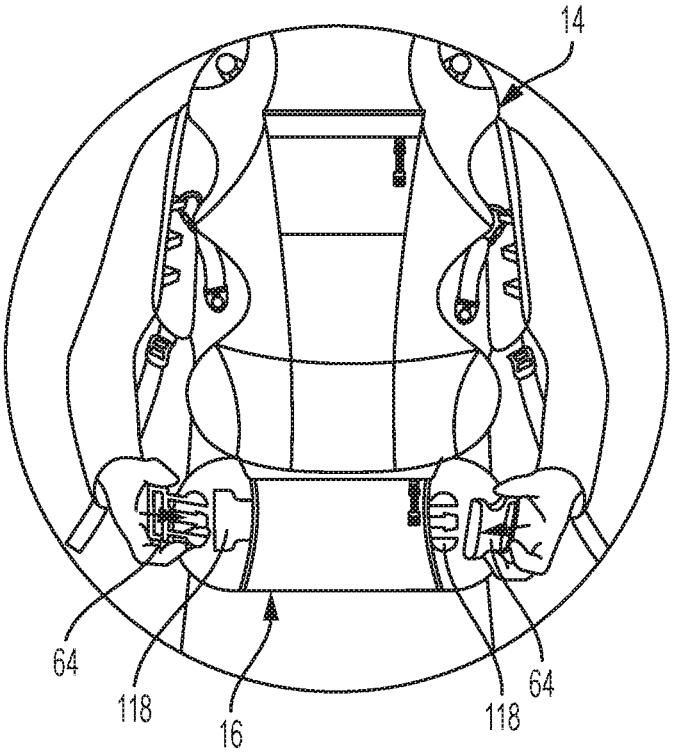
Figure 18A:
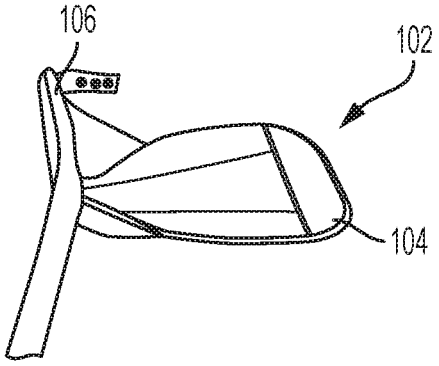
FIGS. 18A-F depicts an exemplary sequence of steps for placing a child in the child insert.
Figure 18B:
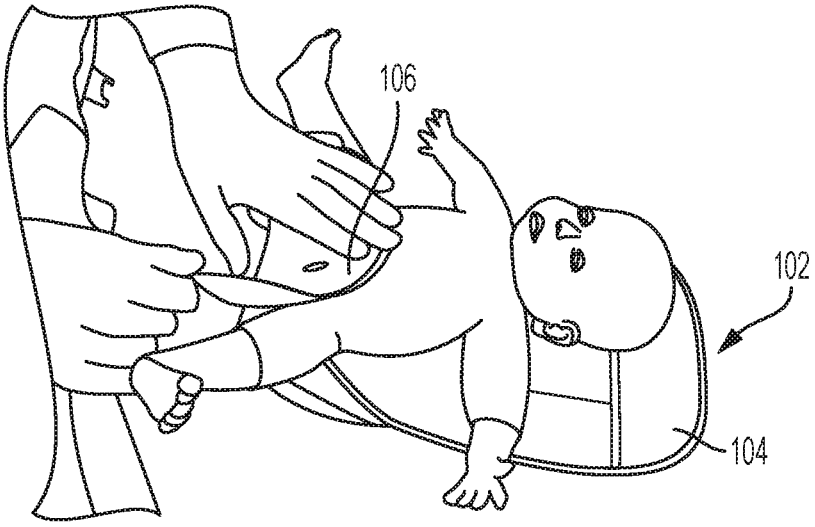
Figure 18C:
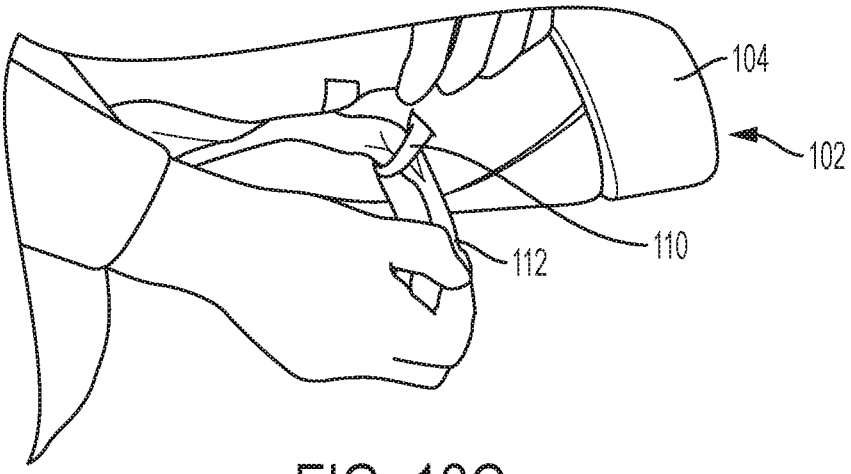
Figure 18D:
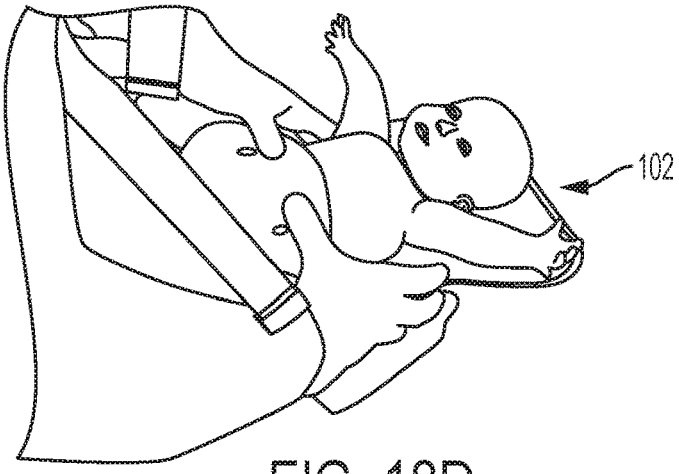
Figure 18E:
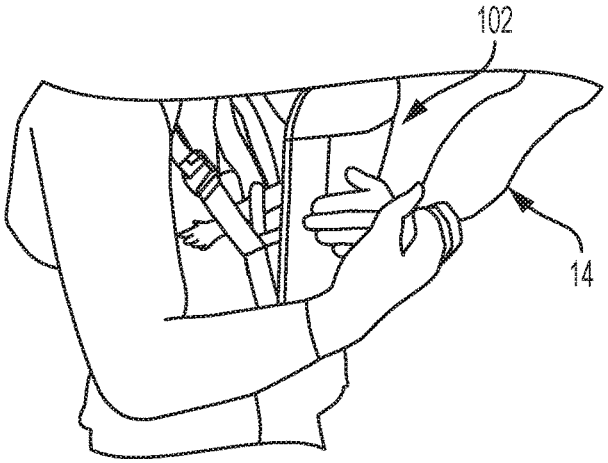
Figure 18F:
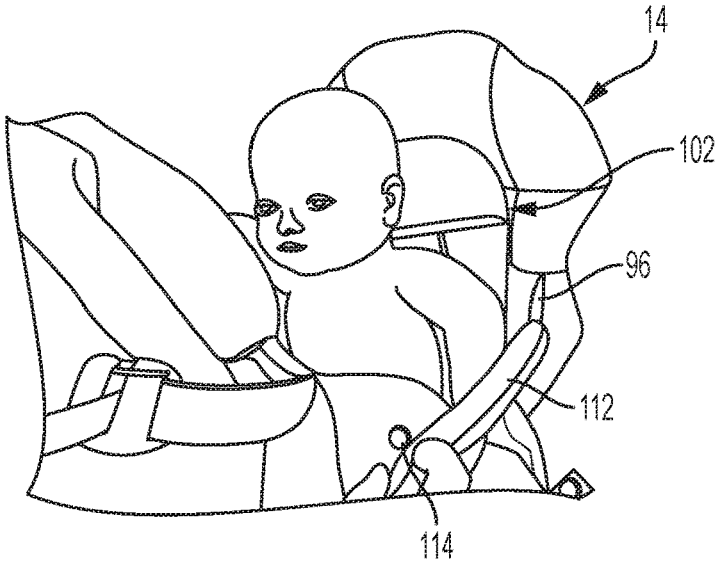

Referring now to FIG. 17, when the carrier system 10 is used in the infant carry mode and the front carry mode, the harness 12 is used in combination with the primary support 14 and the waist pad 16, with the primary support 14 and waist pad 16 extending in front of the wearer, and the lower panel 22 of the harness 12 extending over the back of the wearer. As shown in FIG. 17(*a*), the primary support 14 may be connected to the waist pad 16 via a zipper 120. The waist pad connectors 118 may be connected to the harness belt connectors 64, as shown in FIG. 17(*b*). When such connection is made, the combination of the waist pad 16 and harness belt 60 completely circumnavigate the wearer's waist.

With regard to the infant carry mode, the infant insert 102 is connected to the primary support 14 to more securely cradle and support the infant. FIG. 18 depicts an exemplary sequence of steps for securing the infant insert 102 to the infant. FIG. 18(*a*) shows the infant insert 102 placed on a flat support surface, with the torso support panel 104 extending over the flat support surface. The infant is carefully placed on the infant insert 102, with the infant's torso being placed on the torso support surface 104. The seat support panel 106 is then placed between the infant's legs, as shown in FIG. 18(*b*). The straps 112 are passed through respective ones of the loops 110, as shown in FIG. 18(*c*). In particular, each strap 112 is passed through the loop 110 located on the same side of the infant insert 102 as the corresponding strap 112. When both straps 112 have been passed though the corresponding loops 110, and with the free ends of the straps 112 remaining free, the wearer then carefully lifts the infant and the infant insert 102, as shown in FIG. 18(*d*) and places the infant against the wearer's chest, with the infant facing the wearer's chest. The wearer then maintains a secure hold of the infant with one hand, while lifting the primary support 14 with the other hand, to extend upwardly behind the infant, as shown in FIG. 18(*e*). The free ends of the straps 112 are then passed through the corresponding loops 96 formed on the primary support 14, as shown in FIG. 18(*f*). The free ends of the straps 112 are then connected to the torso support panel 104 using the fasteners 114. Upon connection of the straps 112 to the torso support panel 104, the infant insert 102 is secured to the primary support 14. The detachable straps 144 are then connected to the lower connectors 88 on the primary support 14, and the second straps 50 are connected to the upper connectors 86 on the primary support 14. The infant carry mode may be suitable for infants that are 0-3 months or that weigh approximately 7-13 pounds.

Figure 19A:
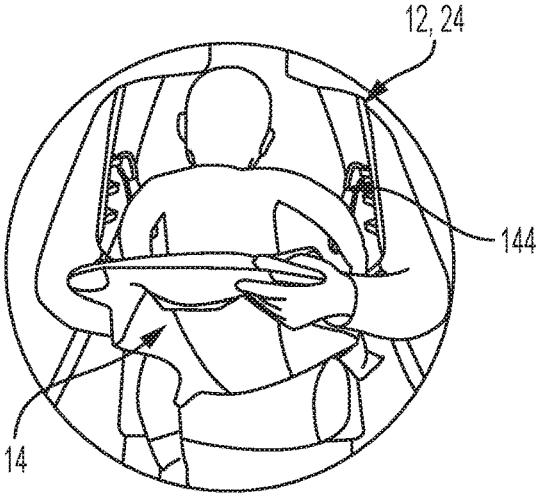
FIGS. 19A-C depicts an exemplary sequence of steps for transitioning the carrier system into a front carry mode.
Figure 19B:
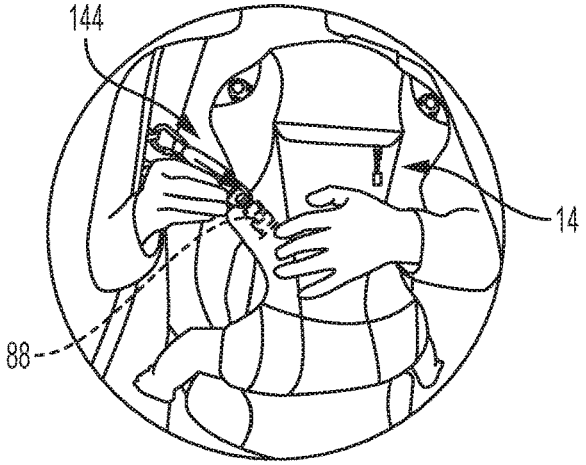
Figure 19C:
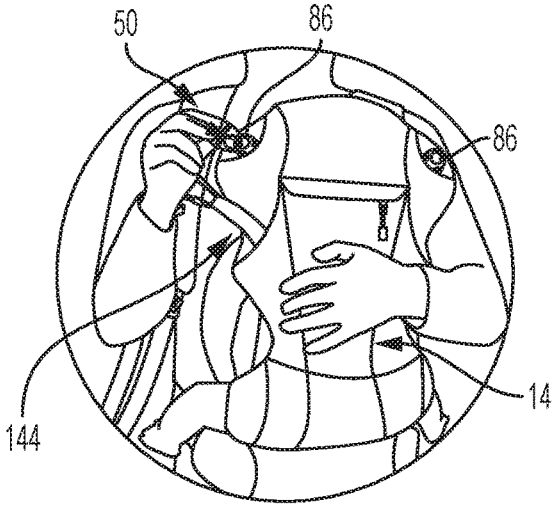

An example of the front carry mode is depicted in FIG. 19, and is very similar to the infant carry mode explained above. The primary distinction is that the front carry mode does not utilize the infant insert 102. The front carry mode may be suitable for children that are older than three months. Once the harness 12 is positioned on the wearer, and the primary support 14 and waist pad 16 are connected to the harness belt 60, the child is positioned against the wearer's chest, with the child's legs extending on opposite sides of the wearer, as shown in FIG. 19(*a*). The detachable straps 144 are then connected to the lower connectors 88 on the primary support 14, as shown in FIG. 19(*b*), and the second straps 50 are connected to the upper connectors 86 on the primary support 14, as shown in FIG. 19(*c*).

In both the infant carry mode and the front carry mode, the child may be secured directly against the wearer's chest. In this regard, no portion of the harness 12 or primary support 14 may extend between the child and the wearer, and thus, the child may be comfortably and intimately supported against the wearer. Furthermore, the child's face may be in view to the wearer at all times by simply glancing down. The fabric of the harness 12, primary support 14, or infant insert 102 does not close around the child's face.

Figure 20A:
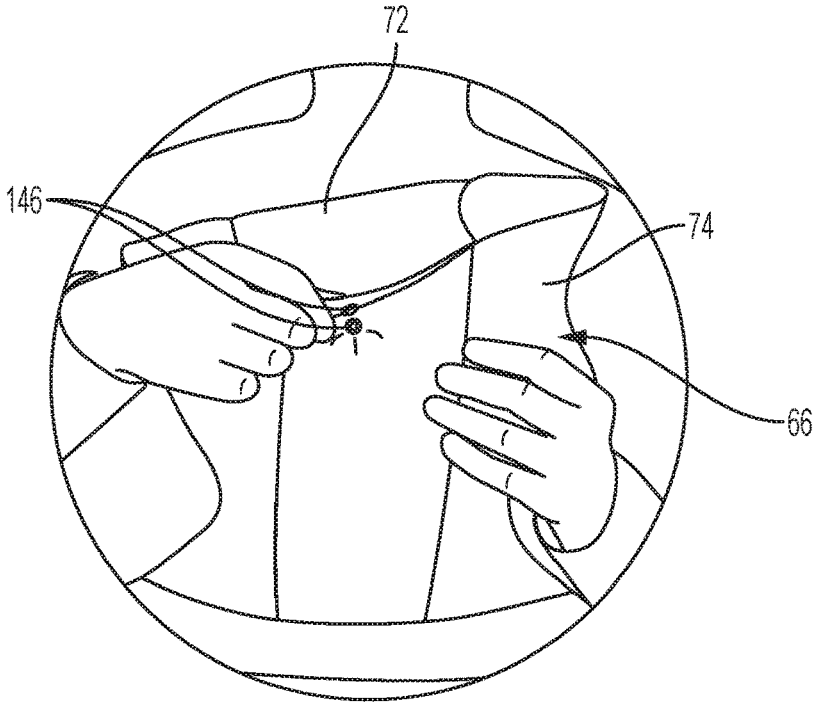
FIGS. 20A-C depicts an exemplary sequence of steps for transitioning the carrier system into a world facing mode.
Figure 20B:
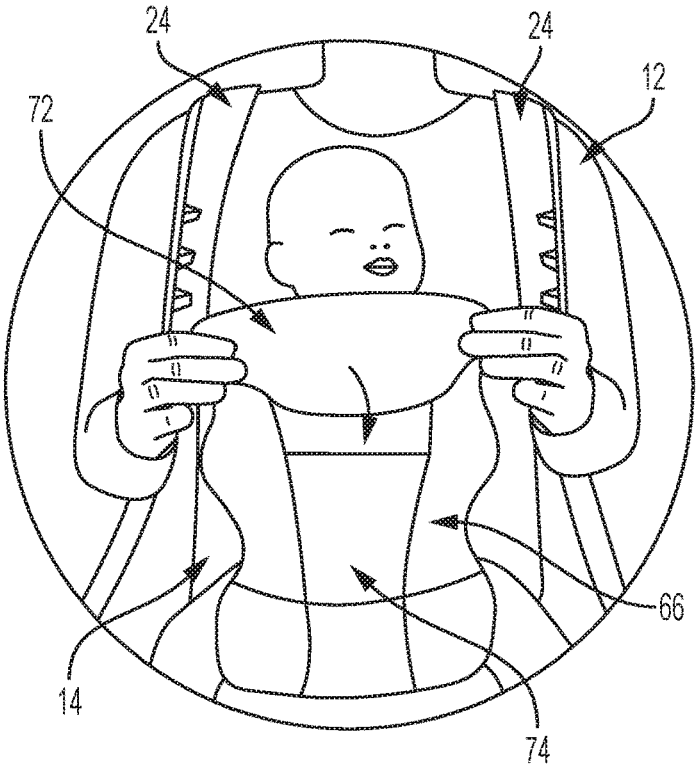
Figure 20C:
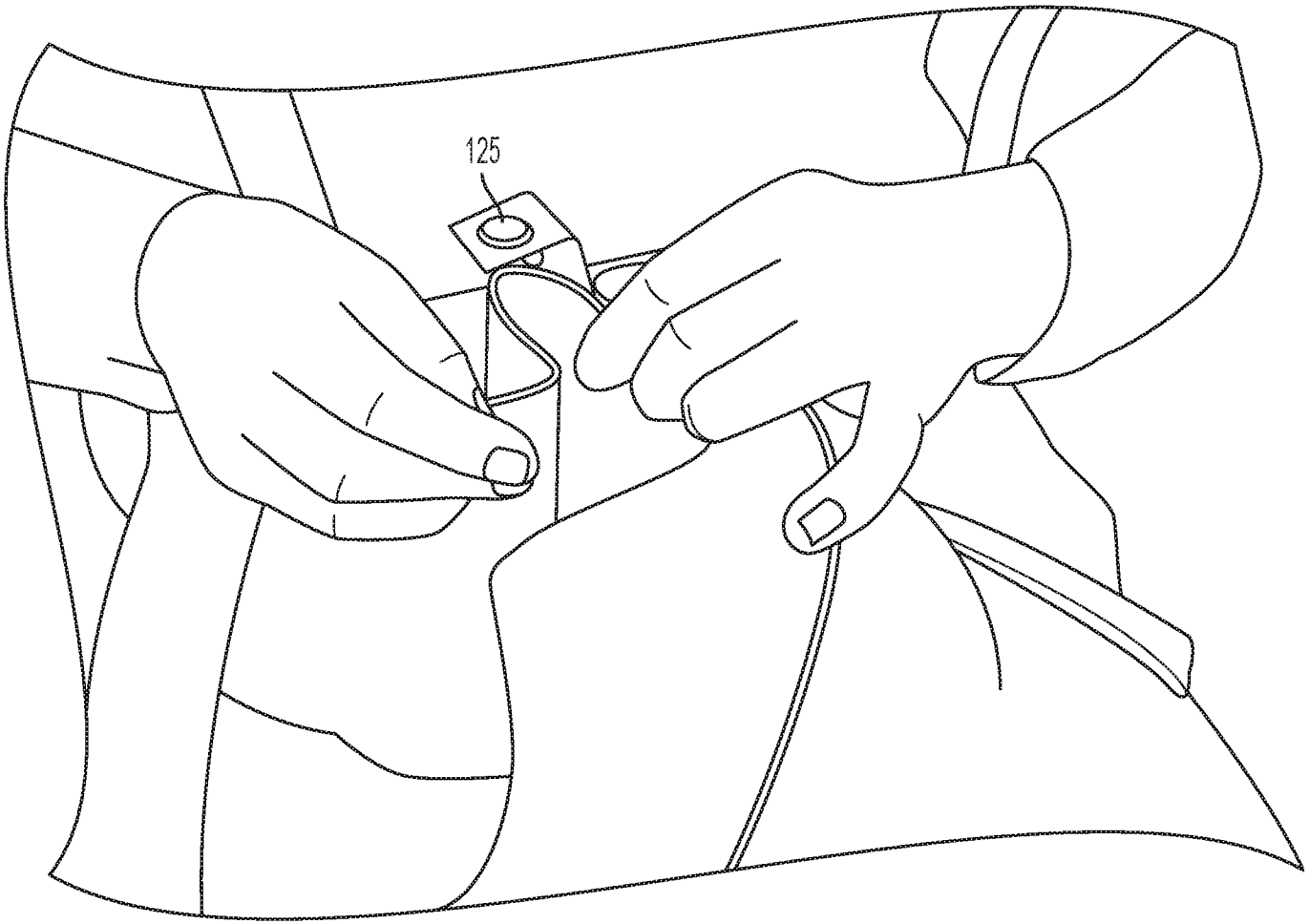
Figure 21A:
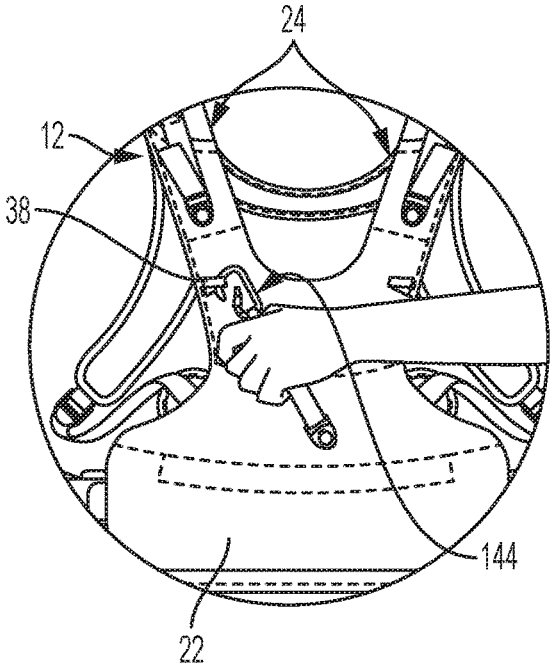
FIGS. 21A-J depicts an exemplary sequence of steps for transitioning the carrier system into a back-carry mode.
Figure 21B:
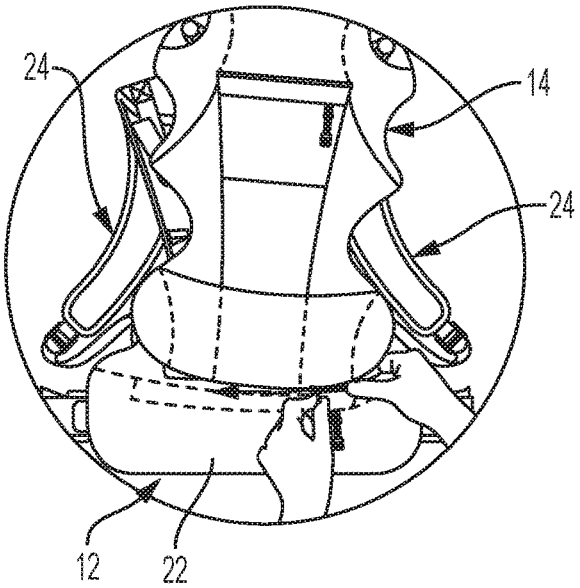
Figure 21C:
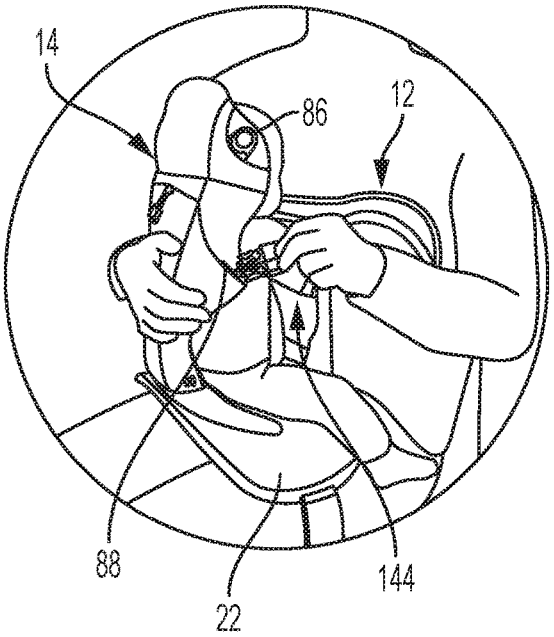
Figure 21D:
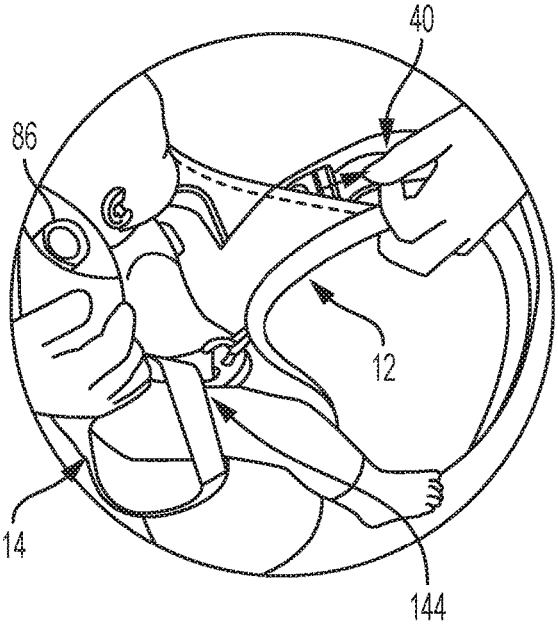
Figure 21E:
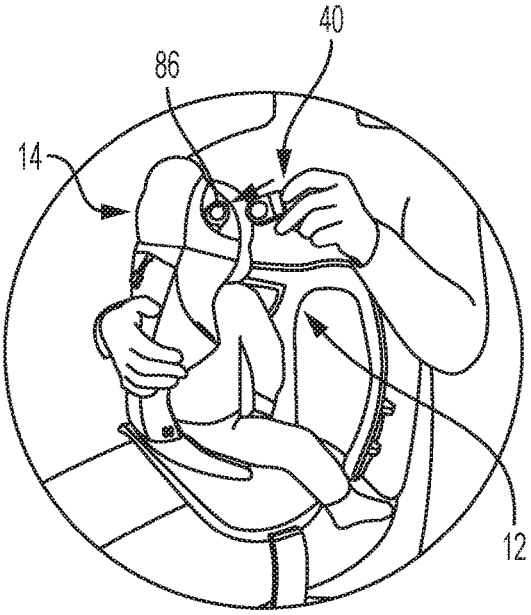
Figure 21F:
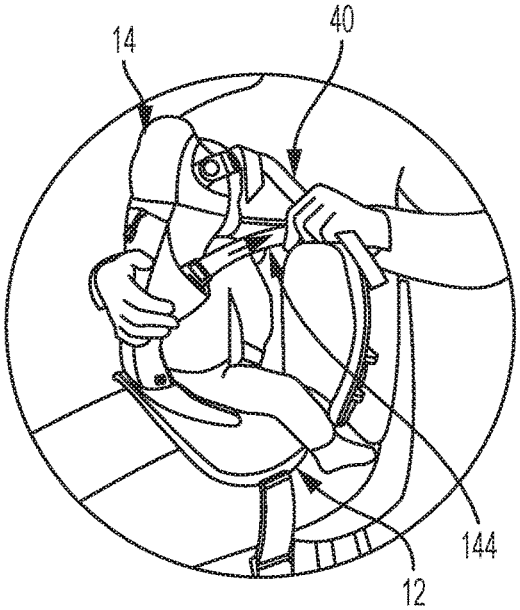
Figure 21G:
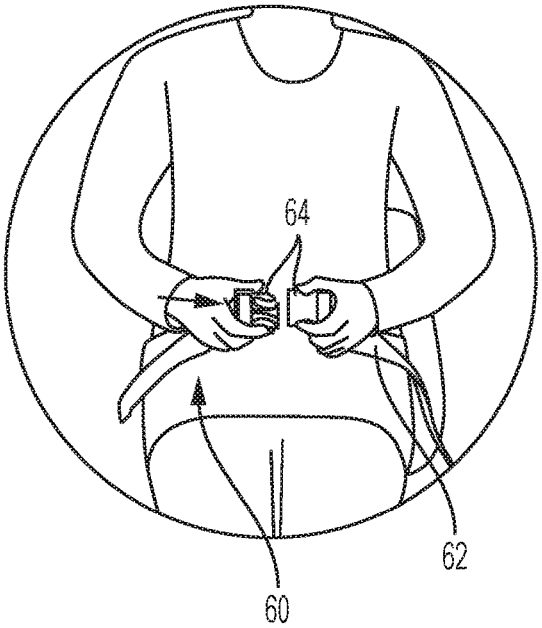
Figure 21H:
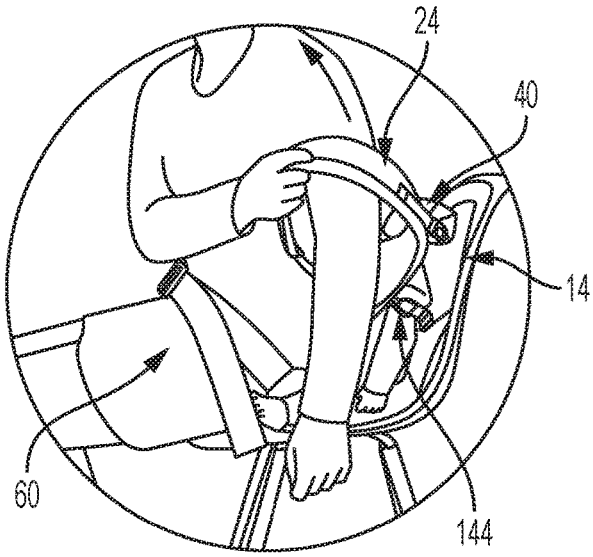
Figure 21I:
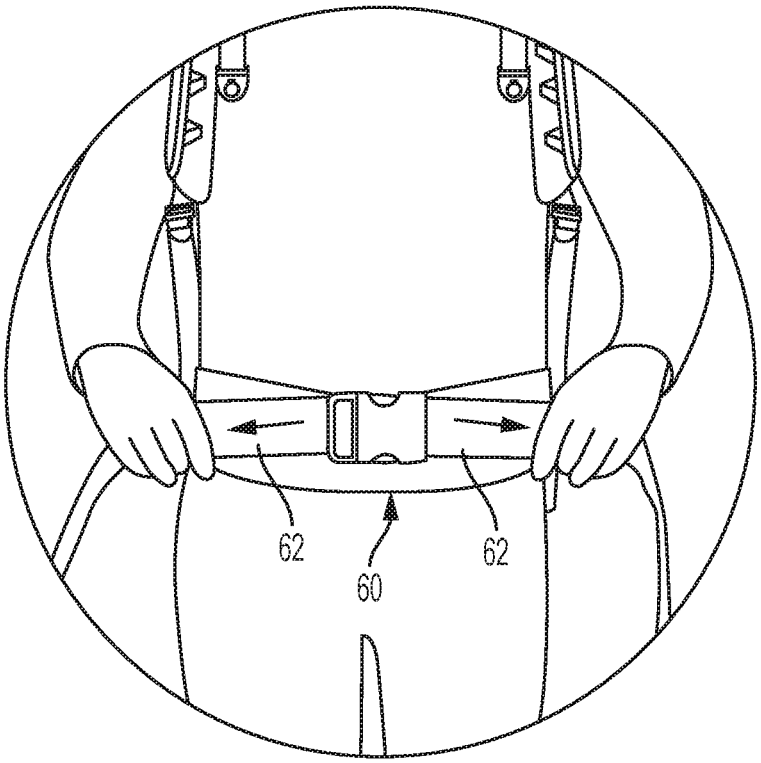
Figure 21J:
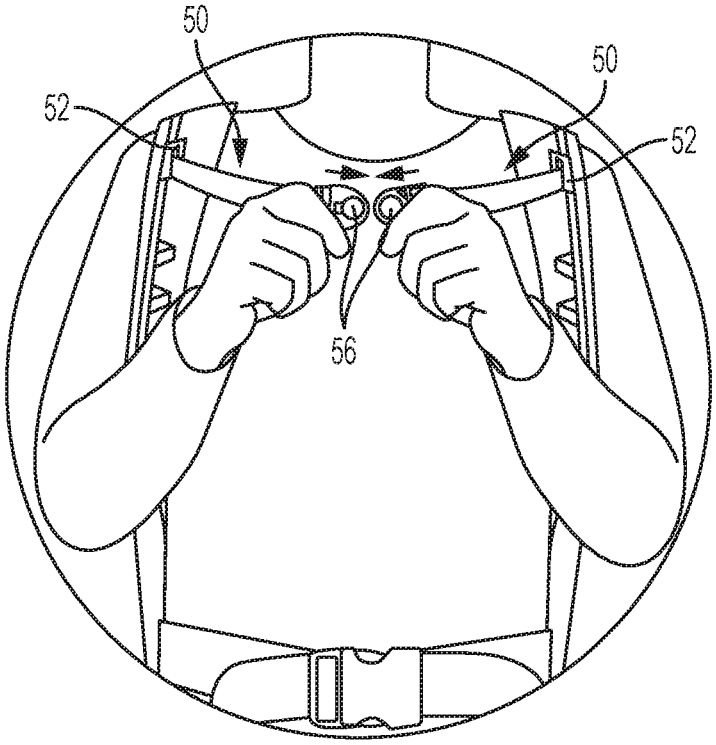

An example of the world facing mode is depicted in FIG. 20. In the world facing mode, the harness 12 is worn by the wearer in the generally the same manner as described above in connection with the infant carry mode and front carry mode. However, the upper connectors 86 are disconnected from the second straps 50 to allow the upper portion 72 of the main body 66 to fold over the lower portion about the crease 76. The upper portion 72 may be secured to the lower portion 74 via cooperating fasteners 146 located on the upper and lower portions 72, 74, as shown in FIGS. 20(*a*) and 20(*b*). The seat of the carrier may be narrowed in the world facing mode. Along these lines, a lower portion of the main body 66 of the primary support 14 may be folded and secured using a fastener 125, as shown in FIG. 20(*c*). When not used in the world facing mode, such fastener may be disconnected, to allow the main body 66 to assume its natural, unfolded configuration (e.g., a wide configuration).

In the infant carry mode, the front carry mode, and the world facing mode, the child's head should be as close to the wearer's chin as is comfortable. The wearer should be able to kiss the child on the head or forehead by simply tipping the wearer's head forward.

The back-carry mode will now be described with reference to FIG. 21, which depicts a sequence of configuring the system 10 for use in the back-carry mode. The detachable straps 144 are connected to rear mounting loops 38, as shown in FIG. 21(*a*). The primary support 14 is attached to the lower panel 22 of the harness 12, as shown in FIG. 21(*b*), via a zipper or other fastener known in the art, such that the primary support 14 and the harness 12 collectively define a cavity for receiving the child. The wearer then places the child in the cavity. Once the child is in the cavity, the wearer may support the child on one of the wearer's legs, as shown in FIG. 18(*c*). FIG. 18(*c*) also depicts the detachable straps 144 being connected to the lower connectors 88. The first straps 40 are removed from their respective pockets, as shown in FIG. 21(*d*), and are connected to the upper connectors 86, as shown in FIG. 21(*e*). All of the straps 40, 144 are tightened, as shown in FIG. 21(*f*), to keep the child snug and safe. The child, while remaining in the cavity, is placed onto a seat and the harness belt 60 is secured around the wearer's waist by connecting the harness belt connectors 64 to each other, as shown in FIG. 21(*g*). The wearer then dons the harness 12 by placing the wearer's arms through the shoulder straps 24, as shown in FIG. 21(*h*). Once the wearer is standing, the harness belt 60 and shoulder straps 24 are tightened, as shown in FIG. 21(*i*). The second straps 50 are then connected to each other so as to extend between the shoulder straps 24 across the wearer's chest, as shown in FIG. 21(*j*).

In the various carrier modes explained above, the straps included on the carrier allow the carrier to be tight enough to hug the child close to the wearer, as this typically provides comfort to both the wearer and the child. If the carrier is too loose, the slack or loose fabric may allow the child to slump down in the carrier, which can hinder the child's breathing and pull on the wearer's back. Furthermore, the carrier should not be so tight that the child's chin is forced onto their chest, as this may restrict the child's breathing. In an upright carrying position, the child should be held comfortably close to the wearer so the child's back is supported in its natural position and the child's tummy and chest are against the wearer. If the carrier is too loose, the child can slump which can partially close the child's airway.

Figure 22:
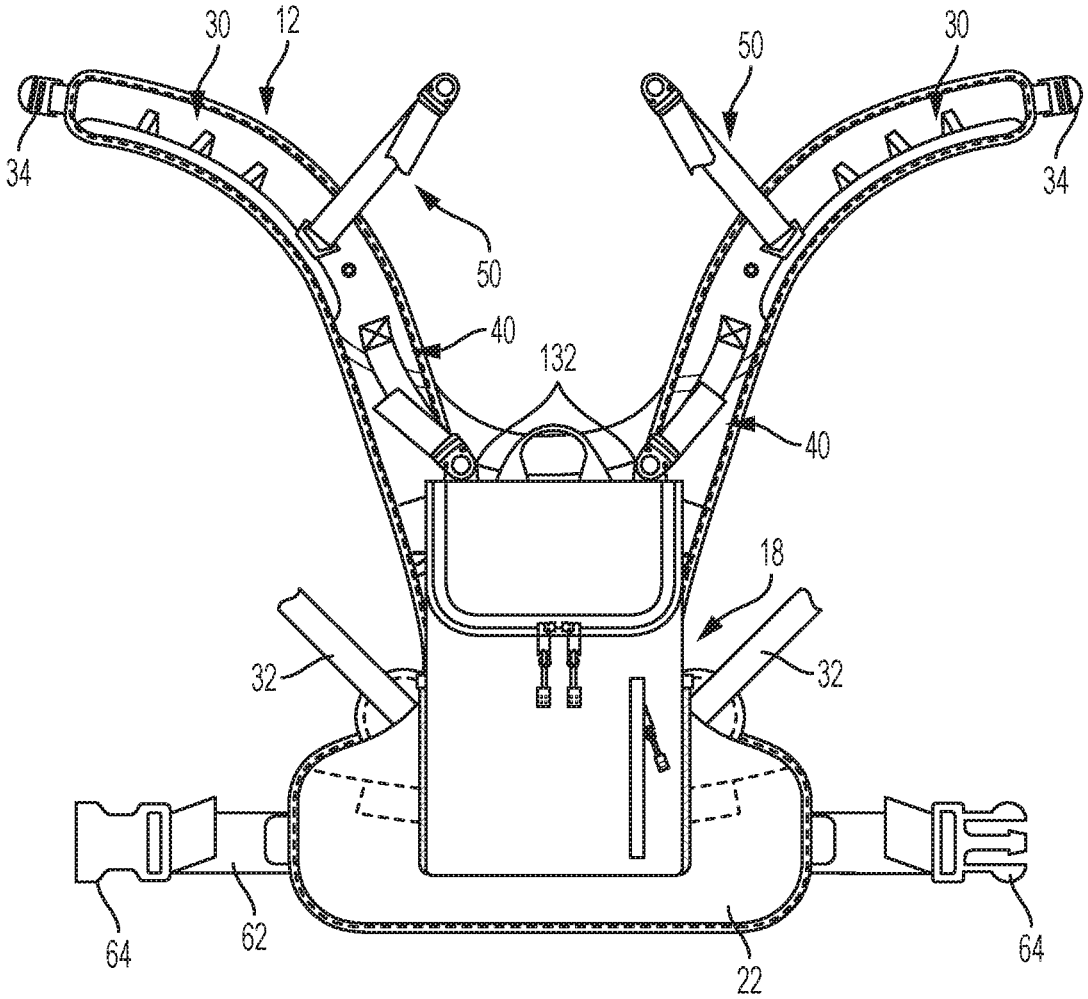
FIG. 22 depicts the carrier system in a day pack carry mode.

FIG. 22 shows the system 10 in the day pack carry mode, with the day pack 18 connected to the harness 12. In particular, the first straps 40 on the harness 12 are connected to the buckles 132 on the day pack 18 to allow a wearer to easily carry the day pack 18 when wearing the harness 12.

The particulars shown herein are by way of example only for purposes of illustrative discussion, and are not presented in the cause of providing what is believed to be most useful and readily understood description of the principles and conceptual aspects of the various embodiments of the present disclosure. In this regard, no attempt is made to show any more detail than is necessary for a fundamental understanding of the different features of the various embodiments, the description taken with the drawings making apparent to those skilled in the art how these may be implemented in practice.

What is claimed is:

1. An adaptable child carrier system comprising:

a harness having a pair of shoulder straps, a lower panel, and a harness belt, the pair of shoulder straps extending from the lower panel, the harness being wearable by a wearer with the pair of shoulder straps extending over respective ones of the wearer's shoulders, the lower panel extending over a portion of the wearer's back, and the harness belt extending about the wearer's waist;

a primary support releasably attached to the harness and defining at least first and second sets of attachment points, and a third attachment point, at prescribed locations thereon;

a first set of mounting loops and a second set of mounting loops coupled to respective ones of the pair of shoulder straps, the mounting loops of each of the first and second sets thereof being arranged in prescribed spatial relationships relative to each other along a respective one of the shoulder straps for selective interconnection with the primary support;

a first pair of connecting straps attached to and extending from respective ones of the shoulder straps of the harness, the connecting straps of the first pair being releasably attachable to respective ones of the attachment points of the first set;

a second pair of connecting straps attached to and extending from respective ones of the shoulder straps of the harness, the connecting straps of the second pair being releasably attachable to respective ones of the attachment points of the first set; and a third pair of connecting straps selectively extensible between the primary support and the harness in a manner wherein one of the connecting straps of the third pair is releasably attached to and extends between one of the mounting loops of the first set and a corresponding one of the attachment points of the second set, and the remaining one of the connecting straps of the third pair is releasably attached to and extends between one of the mounting loops of the second set and the remaining one of the attachment points of the second set;

the child carrier system being selectively transitionable between a first configuration and a second configuration without removal of the harness from the wearer;

the primary support, when in the first configuration, being attached to the harness via the second and third pairs of connecting straps without the use of the first pair of connecting straps such that the lower panel and the primary support are separated from each other so as to reside on opposed sides of the wearer's torso when worn by the wearer;

the primary support, when in the second configuration, being attached to the lower panel via the third attachment point and to the remainder of the harness via at least the first and third pairs of connecting straps without the use the second pair of connecting straps, to define a cavity to receive the child for carrying the child adjacent the wearer's back.

2. The child carrier system recited in claim 1, further comprising a waist pad detachably engageable with the third attachment point of the primary support when the child carrier system is in the first configuration and having a second waist belt portion selectively engageable with the harness belt portion to extend around a wearer.

3. The child carrier system recited in claim 2, wherein the primary support includes a first fastener which defines the third attachment point and the waist pad includes a second fastener selectively engageable with the first fastener.

4. The child carrier system recited in claim 3, wherein the lower panel of the harness includes a third fastener engageable with the first fastener when the child carrier system is in the first configuration.

5. The child carrier system recited in claim 4, wherein the first and second fasteners include cooperatively engageable zipper components, and the first and third fasteners include cooperatively engageable zipper components.

6. The child carrier system recited in claim 1, wherein the entirety of each of the first second pair of connecting straps is slidably coupled to a respective one of the pair of shoulder straps.

7. The child carrier system recited in claim 6, further comprising a pair of rails connected to respective ones of the pair of shoulder straps, the second pair of connecting straps each including a slider movably coupled to a respective one of the rails.

8. The child carrier system recited in claim 1, further comprising a crotch support coupled to the primary support.

9. The child carrier system recited in claim 1, further comprising a storage pack, the child carrier system being transitional to a third configuration wherein the storage pack is engaged with the harness using only the first pair of connecting straps.

10. An adaptable child carrier system comprising:

a harness having a lower panel and a harness belt, the harness being wearable by a wearer with a portion of the harness extending over the wearer's shoulders, the lower panel extending over a portion of the wearer's back, and the harness belt extending about the wearer's waist;

a primary support releasably attached to the harness and defining at least first and second sets of attachment points, and a third attachment point, at prescribed locations thereon;

a first set of mounting loops and a second set of mounting loops coupled to prescribed locations of the harness, the mounting loops of each of the first and second sets thereof being arranged in prescribed spatial relationships relative to each other for selective interconnection with the primary support;

a first pair of connecting straps attached to and extending from respective portions of the harness, the connecting straps of the first pair being releasably attachable to respective ones of the attachment points of the first set;

a second pair of connecting straps attached to and extending from respective portions of the harness, the connecting straps of the second pair being releasably attachable to respective ones of the attachment points of the first set;

a third pair of connecting straps selectively extensible between the primary support and the harness in a manner wherein one of the connecting straps of the third pair is releasably attached to and extends between one of the mounting loops of the first set and a corresponding one of the attachment points of the second set, and the remaining one of the connecting straps of the third pair is releasably attached to and extends between one of the mounting loops of the second set and the remaining one of the attachment points of the second set; and a waist pad selectively attachable to the primary support and the harness;

the child carrier system being selectively transitionable between a first configuration and a second configuration while the harness is worn by the wearer;

in the first configuration, the primary support being attached to the harness and the waist pad, the primary support being attached to the harness via the second and third pair of connecting straps without the use of the first pair of connecting straps, such that the lower panel and the primary support are separated from each other so as to reside on opposed sides of the wearer's torso when worn by the wearer;

in the second configuration, the primary support being detached from the waist pad and attached to the lower panel and the remainder of the harness via at least the first and third pairs of connecting straps without the use of the second pair of connecting straps, such that the primary support and the lower panel define a cavity to receive the child for carrying the child adjacent the wearer's back.

11. The child carrier system recited in claim 10, wherein the waist pad is detached from the harness when the child carrier system is in the second configuration.

12. The child carrier system recited in claim 10, wherein the primary support includes a first fastener which defines the third attachment point and the waist pad includes a second fastener selectively engageable with the first fastener.

13. The child carrier system recited in claim 12, wherein the lower panel of the harness includes a third fastener engageable with the first fastener when the child carrier system is in the second configuration.

14. The child carrier system recited in claim 13, wherein the first and second fasteners include cooperatively engageable zipper components, and the first and third fasteners include cooperatively engageable zipper components.

15. The child carrier system recited in claim 10, wherein the entirety of each of the second pair of connecting straps is slidably coupled to the harness.

16. The child carrier system recited in claim 10, further comprising a storage pack, the child carrier system being transitional to a third configuration wherein the storage pack is engaged with the harness.

* * * * *